US006801232B2

(12) United States Patent
Nagamine et al.

(10) Patent No.: US 6,801,232 B2
(45) Date of Patent: Oct. 5, 2004

(54) DISTANCE MAINTAINING MEMBER BETWEEN OPTICAL HEAD AND IMAGE DRUM

(75) Inventors: Masamitsu Nagamine, Tokyo (JP); Norio Nakajima, Hachioji (JP); Yu Kobayashi, Hachioji (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/115,677

(22) Filed: Apr. 4, 2002

(65) Prior Publication Data

US 2002/0149664 A1 Oct. 17, 2002

(30) Foreign Application Priority Data

Apr. 6, 2001 (JP) ..... 2001-107909

(51) Int. Cl.[7] ..... B41J 2/39; B41J 2/395; B41J 2/40

(52) U.S. Cl. ..... 347/149

(58) Field of Search ..... 347/123, 141, 347/149, 138; 399/118, 126, 177

(56) References Cited

U.S. PATENT DOCUMENTS 3,890,038 A * 6/1975 Ichikawa
4,257,054 A * 3/1981 Ishikawa ..... 347/149
4,258,372 A * 3/1981 Ishikawa ..... 347/149
4,703,334 A * 10/1987 Mochimaru et al. ..... 347/138
5,339,132 A * 8/1994 Tomita et al.
6,055,006 A * 4/2000 Murano ..... 347/118

FOREIGN PATENT DOCUMENTS

JP 62175782 A * 8/1987 ..... G03G/15/04
JP 03039756 A * 2/1991 ..... G03G/15/00
JP 11249049 A * 9/1999 ..... G02B/26/10
JP 2001010109 A * 1/2001 ..... B41J/2/44

* cited by examiner

*Primary Examiner*—Susan Lee
(74) *Attorney, Agent, or Firm*—Akin Gump Strauss Hauer & Feld, LLP

(57) ABSTRACT

A positioning apparatus for an optical head includes a cylindrical photoconductive drum, an optical head, and at least one spacer. The cylindrical photoconductive drum extends in a direction of a longitudinal axis thereof. The optical head extends parallel to the longitudinal axis. The spacer is disposed to abut the photoconductive drum, limiting a distance between the optical head and the photoconductive drum. The photoconductive drum has a photoconductor and the spacer is in contact with the photoconductor through sliding friction. The spacer has a first surface in contact with the photoconductor. The photoconductor has a second surface in contact with the first surface. The first surface has a first curvature and the second surface has a second curvature. When the first surface is pressed against the second surface, the spacer may deform resiliently so that the first curvature becomes substantially equal to the second curvature.

12 Claims, 26 Drawing Sheets

DISTANCE MAINTAINING MEMBER BETWEEN OPTICAL HEAD AND IMAGE DRUM

BACKGROUND OF THE INVENTION

1. Field of the Invention

The present invention relates to an optical head positioning apparatus.

2. Description of the Related Art

An electrophotographic printer that employs an LED head incorporates a photoconductive drum, which is positioned so that a charged surface of the photoconductive drum is at a focal point of a convergent lens such as a SELFOC lens array (SLA). During an exposure process of the electrophotographic printer, light emitted from LED array chips illuminates the surface of the photoconductive drum through the SLA to form an electrostatic latent image on the surface.

FIG. 35 is a cross-sectional view of a conventional LED head.

An LED array chip 1 is mounted on a printed circuit board 3. An SLA holder 4 holds an SLA 2 thereon. A base 5 holds the printed circuit board 3, SLA holder 4, and SLA 2 thereon and accurately positions them relative to the surface of the photoconductive drum 6. In order to focus an image on the photoconductive drum 6, the LED head requires to be accurately positioned with respect to the photoconductive drum 6. Thus, the LED head is positioned so that a distance Lo from the LED chip 1 to a light-entering surface of the SLA 2 is equal to a distance Li from the light-exiting surface of the SLA 2 to a focal point on the photoconductive drum 6. The SLA 2 is the distance Lo away from the LED array chip 1 and is fixed to the SLA holder 4 by an adhesive. In other words, the distance Lo cannot be adjusted once the SLA 2 has been mounted on the SLA holder 4. Thus, the photoconductive drum 6 should be positioned accurately relative to the LED head so that the distance Lo is equal to the distance Li.

FIG. 36 is a front view of the conventional LED head.

The positional relation between the conventional photoconductive drum 6 and the LED head will be described with reference to FIG. 36. The photoconductive drum 6 has one axial end to which a gear 7 is mounted and the other axial end to which a flange 11 is mounted. The gear 7 and flange 11 are formed with a hole 9 and a hole 10 therein, respectively, through which a shaft 8 of the photoconductive drum 6 extends. The gear 7 and flange 11 rotate on the shaft 8. The gear 7 is driven in rotation by a drive source, not shown, thereby driving the photoconductive drum 6 to rotate.

The photoconductive drum 6 is disposed in an ID unit, not shown, and is covered with an upper frame 16 such that the photoconductive drum 6 is shielded from light except a surface area that opposes the light-exiting end of the SLA 2. The shaft 8 is rotatably supported at its longitudinal end portions by side frames 12*a* and 12*b* of the ID unit. Adjusting mechanisms 13*a* and 13*b* are disposed under both end of the SLA holder 4 and operated to adjust the distance Li between the light-exiting end of the SLA 2 and the surface of the photoconductive drum 6.

The adjusting mechanisms are fixed permanently after adjusting the distances Lo and Li. The LED head is urged toward the shaft 8 of the photoconductive drum 6 by springs 14*a* and 14*b*, which are mounted on an upper portion of the both end portions of the LED head. The adjusting mechanisms 13*a* and 13*b* abut abutting surfaces 15*a* and 15*b* formed on the side frames 12*a* and 12*b*. The adjusting mechanisms 13*a* and 13*b* maintain the distance Li at a fixed value so that light is focused on the surface of the photoconductive drum 6.

The conventional apparatus of the aforementioned construction suffers from the following drawbacks. The distance Li is adjusted with the LED head mounted on a jig. When the thus adjusted LED head is assembled to a printer, the adjusting mechanisms 13*a* and 13*b* abut the abutting surfaces 15*a* and 15*b* of the side frames 12*a* and 12*b* in the ID unit. At this moment, the distance Li changes slightly so that a focal position deviates somewhat from its correct position, preventing formation of well focused images.

This is due to the fact that the distance of the photoconductive drum 6 from the SLA 2 deviates from a designed value Li. The deviation of the distance is within ±100 $\mu$m of the designed Li. The factors that cause the manufacturing variations of Li primarily include tolerances of the shaft 8, holes 9 and 10, the height of the abutting surfaces 15*a* and 15*b*, and the wear of the photoconductive drum 6. For this reason, the adjusting mechanisms 13*a* and 13*b* of each ID unit are adjusted to a corresponding ID unit when the IED head is assembled to the ID unit. However, ID unit is a consumable item. When the ID unit reaches the end of its useful life, the user replaces the ID unit by a new, unused one. Thus, after the ID unit is replaced, the distance Li between the SLA 2 and the surface of the photoconductive drum 6 may be different from that before the ID unit is replaced.

FIG. 37 illustrates the relationship between ΔLi and MTF (Modulation Transfer Function). The closer to 100% the MTF is, the more faithful to an original image the printed image is. From FIG. 37, it can be seen that a deviation of Li of 50 $\mu$m causes a decrease of MTF of more than 10%. For a printer having a resolution of 1200 DPI (about 24 line pairs/mm), a decrease of MTF in excess of 10% impairs the resolution of a printed image.

SUMMARY OF THE INVENTION

An object of the invention is to solve the aforementioned problem.

Another object of the invention is to improve the accuracy of positioning of an LED head with respect to the surface of a photoconductive drum so that an image is focused accurately on the surface of the photoconductive drum.

A positioning apparatus for an optical head includes a cylindrical photoconductive drum, an optical head, and at least one spacer. The cylindrical photoconductive drum extends in a direction of a longitudinal axis. The optical head extends parallel to the photoconductive drum. The at least one spacer is disposed to abut the photoconductive drum, the spacer limiting a distance between the optical head and a surface of the photoconductive drum.

The photoconductive drum has a photoconductor and the spacer is contact with the surface of the photoconductor through sliding friction.

The spacer has a first surface in contact with the surface of the photoconductor. The first surface has a groove formed therein.

The photoconductor has a second surface in contact with the first surface. The first surface has a first curvature and the second surface has a second curvature. When the first surface is pressed against the second surface, the spacer deforms resiliently so that the first curvature becomes substantially equal to the second curvature.

The electrophotographic printer further includes a charging roller that extends in a direction in which the photoconductive drum extends, the charging roller being in contact with the photoconductor. The spacer is located outside of an area in which the charging roller is in contact with the photoconductor.

The photoconductive drum has a member coaxial with the photoconductive drum and rotates in contact with the first surface together with the photoconductive drum.

The second surface of the spacer is on an opposite side from the first surface. The electrophotographic printer further includes an adjusting mechanism that is held sandwiched between the optical head, and the second surface having the second curvature. The adjusting mechanism is operated to adjust the position of the optical head relative to the photoconductive drum. The adjusting mechanism may be an eccentric cam mechanism.

The first surface and the second surface have a curvature and are concentric to each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
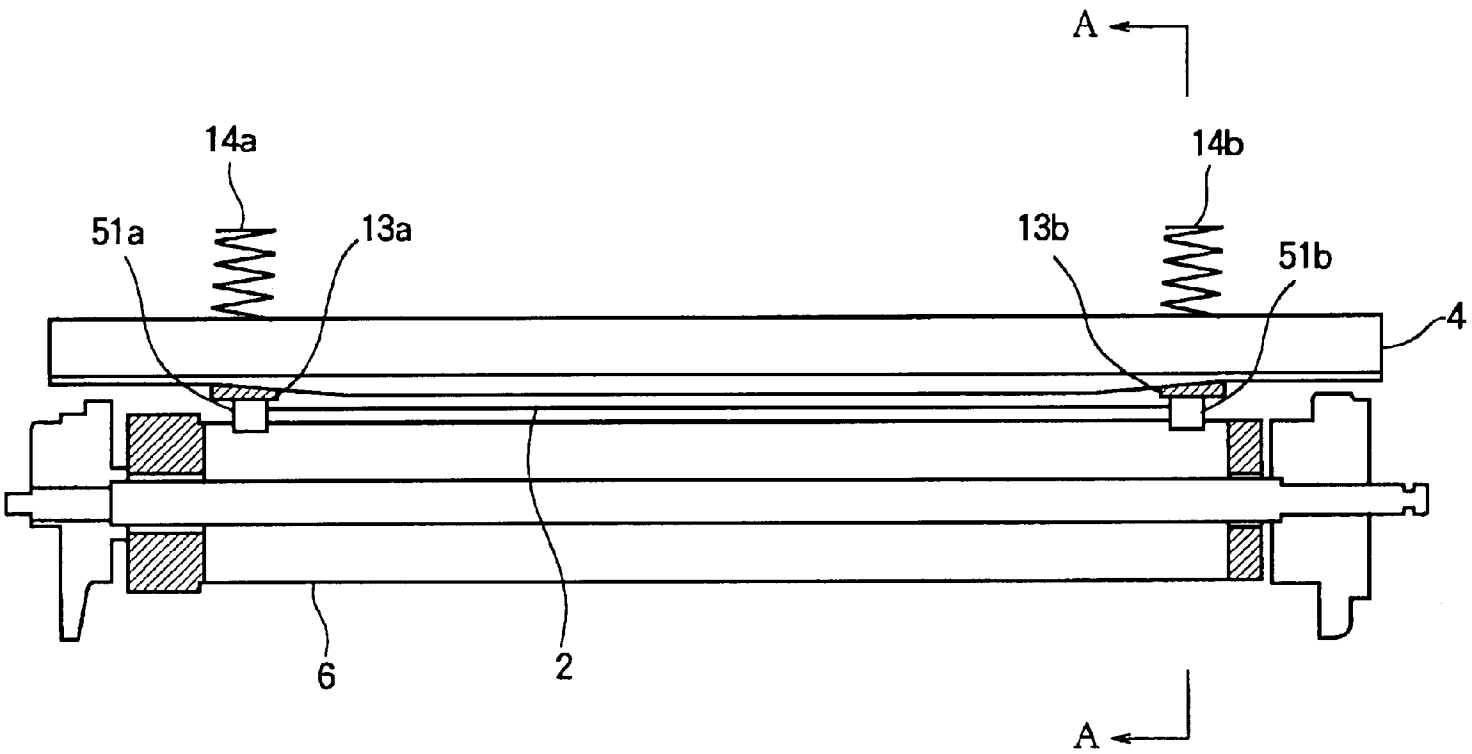
FIG. 1 is a front-view of a first embodiment.

FIG. 1 is a front view of a first embodiment.

A photoconductive drum 6 is generally in the shape of a hollow cylinder. Each of spacers 51*a* and 51*b* has a recessed abutting surface 52, preferably, a curved surface having a curvature that describes an arc. The abutting surface 52 abuts a surface of the photoconductive drum 6. The recessed abutting surface 52 need not have a curvature but may be V-shaped, for example. Adjusting mechanism 13*a* (13*b*) is disposed on the opposite side from the recessed abutting surface 52. Springs 14*a* and 14*b* are mounted on opposed longitudinal end portions of an SLA holder 4 and urge the SLA holder 4 toward the photoconductive drum 6 through the spacers 15*a* and 15*b*. The spacers 51*a* and 51*b* may be secured to the adjusting mechanisms 13*a* and 13*b* or may simply abut the adjusting mechanisms 13 and 13*b*. If the spacers 51*a* and 51*b* simply are to abut the adjusting mechanisms 13 and 13*b*, the spacers 51*a* and 51*b* may be manufactured as separate structural members or may be loosely fitted into holes formed in a chassis, not shown, of the SLA holder 4. Still alternatively, only one spacer may be provided in a longitudinal direction substantially at a midpoint of the photoconductive drum 6.

Figure 2:
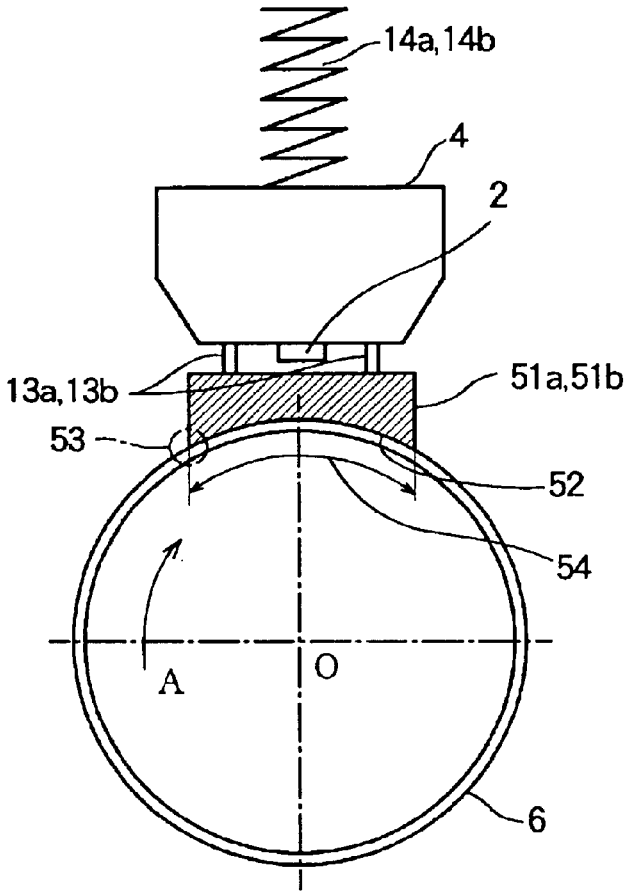
FIG. 2 is a cross-sectional side view taken along the line A—A of FIG. 1.

FIG. 2 is a cross-sectional side view taken along the line A—A of FIG. 1. A small amount of toner may be left on the photoconductive drum 6 after transferring and unwanted toner may adhere to the photoconductive drum 6 during a developing operation. When unwanted toner particles and foreign matters reach the spacers 51*a* and 51*b* as the photoconductive drum 6 rotates in a direction shown by arrow A, edge portions 53 of the spacers 51*a* and 51*b* scratch the unwanted toner particles and foreign matters from the photoconductive drum 6. Thus, the toner is prevented from entering between the spacers 51*a* and 51*b* and the photoconductive drum 6. In addition, the abutting surfaces 52 of the spacers 51*a* and 51*b* rub the surface of the photoconductive drum 6 to rake away the toner particles from a gap between the spacers 51*a* and 51*b* and the photoconductive drum 6. Thus, a film of toner, which will otherwise build up on the photoconductive drum 6, will not push up the spacers 51*a* and 51*b*. Thus, the relation that Li=Lo can be maintained.

Figure 3:
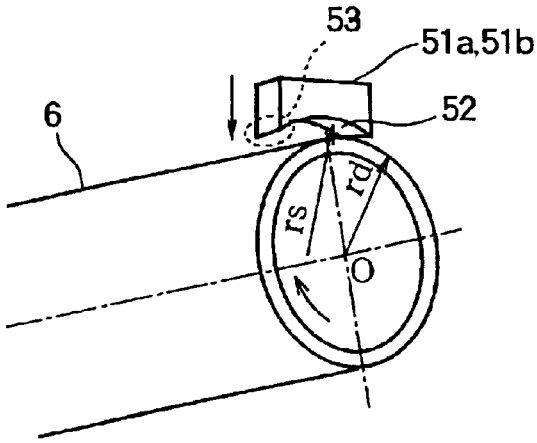
FIG. 3 illustrates the relationship between a curvature of the abutting surface of the spacer and a curvature of the surface of the photoconductive drum.

FIG. 3 illustrates the relationship between a curvature rs of the abutting surface 52 of the spacer and a curvature rd of the surface of the photoconductive drum.

As shown in FIG. 3, the curvature rs of the abutting surface 52 is slightly smaller than, preferably equal to, that rd of the surface of the photoconductive drum 6.

Figure 4:
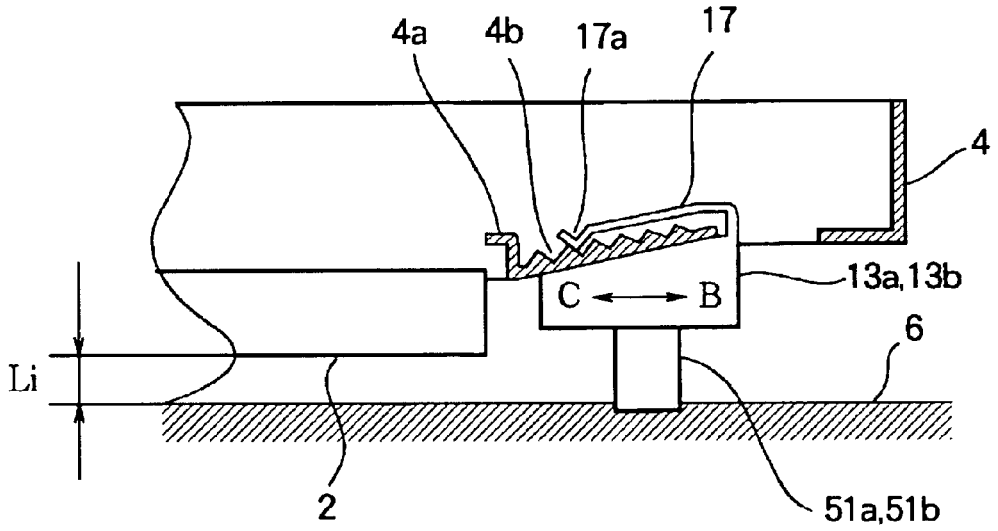
FIG. 4 illustrates the adjusting mechanisms in detail.

FIG. 4 illustrates the adjusting mechanisms 13*a* and 13*b* in detail.

Each of the adjusting mechanisms 13*a* and 13*b* is generally in the shape of a wedge and has a resilient member 17 with a hook 17*a*. The SLA holder 4 has a rack 4*a* having a plurality of grooves 4*b* formed in its surface. The adjusting mechanisms 13*a* and 13*b* are assembled to the SLA holder in such a way that the hook 17*b* engages the groove 4*b*. The adjusting mechanisms 13*a* and 13*b* each have an inclined surface that slides on an inclined surface of the rack 4*a*. The distance Li can be adjusted by incrementally moving the adjusting mechanism 13*a* (13*b*) in a direction shown by arrow C. In other words, operating the adjusting mechanisms 13*a* and 13*b* allows adjustment of the distance Li such that Li=Lo.

Second Embodiment

In the first embodiment, the abutting surface 52 of the spacer 51*a* (51*b*) that abuts the photoconductive drum 6 has preferably the same curvature as the photoconductive drum 6. However, the curvatures of the abutting surface 52 and the photoconductive drum 6 may differ slightly due to manufacturing variations. For this reason, when the spacers 51*a* and 51*b* abut the photoconductive drum 6, only a part of the abutting surface can be brought into contact with the surface of the photoconductive drum 6. A second embodiment is directed to the shape of the spacer 51*a* (51*b*) to ensure that the abutting surface 52 of the spacer 51*a* (51*b*) is brought in its entirety into intimate contact with the photoconductive drum 6.

Figure 5:
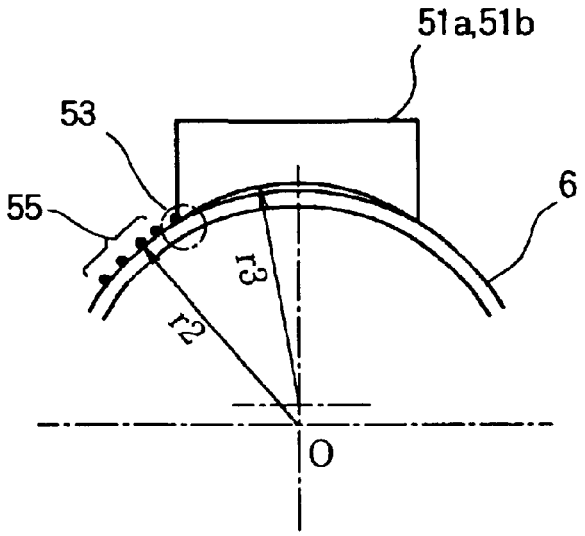
FIG. 5 compares the curvatures of the abutting surface of the spacer and the surface of the photoconductive drum.

FIG. 5 compares the curvatures of the abutting surface of the spacer and the surface of the photoconductive drum.

Referring to FIG. 5, if the curvature rs=r3 of the spacer 51*a* is smaller than that rd=r2 of the photoconductive drum 6, then the edge portion 53 abuts the surface of the photoconductive drum 6. Therefore, the spacers are substantially in line contact with the photoconductive drum 6. As a result, the pressure per unit area (N/cm$^2$) of an area in contact with the photoconductive drum 6 is higher when only a part of the abutting surface contacts the photoconductive drum 6 than when the whole abutting surface contacts the photoconductive drum 6. Thus, when only a part of the abutting surface contacts the photoconductive drum 6, a large frictional force is developed between the spacer 51*a* (51*b*) and the surface of the photoconductive drum 6. The wear of the spacers 51*a* and 51*b* causes the distance Li to decrease with the result that the condition of Li=Lo cannot be maintained.

Figure 6:
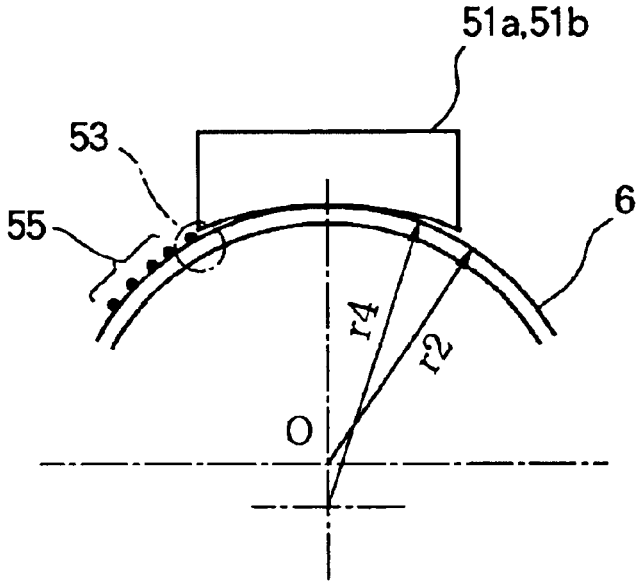
FIG. 6 compares the curvature of the spacer with that of the photoconductive drum.

FIG. 6 compares the curvature of the spacer with that of the photoconductive drum.

If the curvature rs=r4 of the abutting surface 52 is larger than that rd=r2 of the photoconductive drum 6, the edge portions 53 of the spacers 51*a* (51*b*) cannot rake the toner 55 from the photoconductive drum 6. Instead, the toner 55 enters a gap between the spacers 51*a* and 51*b* and the photoconductive drum 6. This construction has a sliding friction through which the toner in the gap is raked from the gap. However, if the toner 55 entering the gap exceeds an amount that can be raked from the gap, the toner 55 will be trapped in the gap. The toner trapped in the gap causes the distance Li to change so that Li is no longer equal to Lo, resulting in poorly focussed images.

Figure 7:
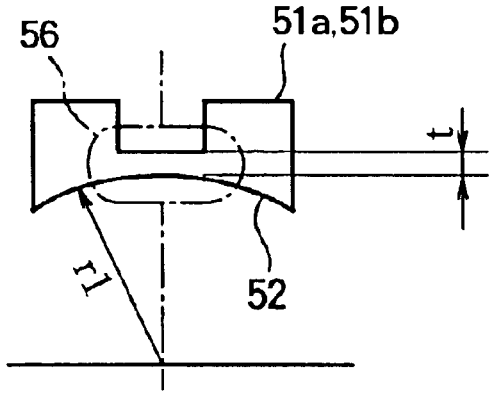
FIG. 7 is a side view of the spacer according to a second embodiment.

FIG. 7 is a side view of the spacer according to the second embodiment.

Figure 8:
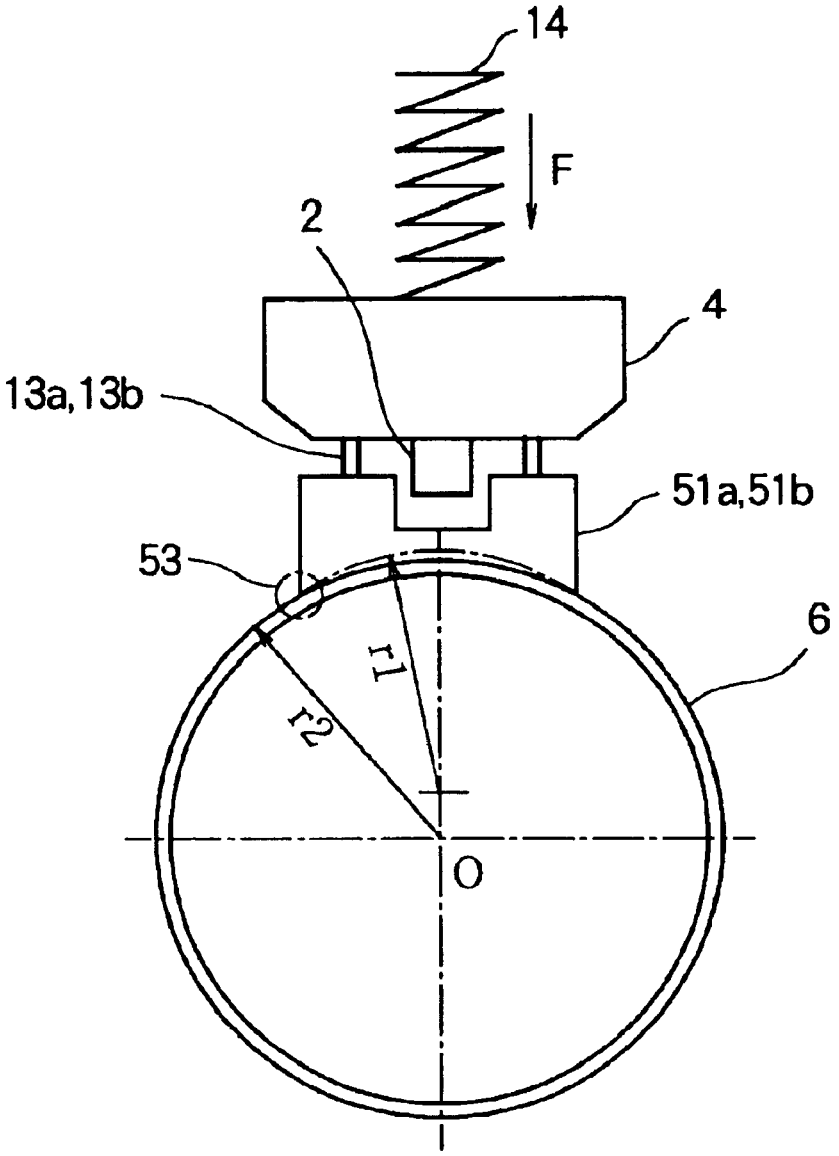
FIG. 8 illustrates details of the spacer according to the second embodiment.

FIG. 8 illustrates details of the spacer according to the second embodiment.

In the second embodiment, the curvature rs of the abutting surface 52 of the spacer 51*a* (51*b*) is smaller than that rd of the photoconductive drum 6. The spacer 51*a* (51*b*) is thinner in a circumferential direction at a midpoint of the abutting surface 52 than at circumferentially end portions of the abutting surface 52. Specifically, the curvature rs of the spacers 51*a* and 51*b* are selected to be rs=r1, and the curvature rd of the photoconductive drum 6 is selected to be rd=r2. The r1 is selected to be about 1% smaller than r2. The thickness t at the middle portion of the spacer is, for example, 1 mm. The spacer 51*a* (51*b*) may be shaped as shown in FIG. 5 by using a resilient material. In the second embodiment, the spacer is of thick construction but may be of thin construction if sufficient resiliency is ensured.

When a resulting urging force F of the springs 14*a* (14*b*) urges the spacers 51*a* and 51*b*, the resilient portion 56 is deformed such that the abutting surface 52 is in intimate contact with the photoconductive drum 6. The intimate contact of the abutting surface 52 makes the curvature rd of the spacer substantially equal to that of the photoconductive drum 6. In other words, the spacers 51*a* and 51*b* are brought into area-contact with the photoconductive drum 6 rather than into line-contact with photoconductive drum 6. Thus, the pressure per unit area (N/cm$^2$) of the surface 52 can be decreased to reduce wear of the spacers 51*a* and 51*b* and the photoconductive drum 6. As the photoconductive drum 6 rotates, the toner 55 deposited on the photoconductive drum 6 reaches the spacers 51*a* and 51*b* and the edge portions 53 of the spacers 51*a* and 51*b* scrape the toner 55 off the photoconductive drum 6.

Figure 9:
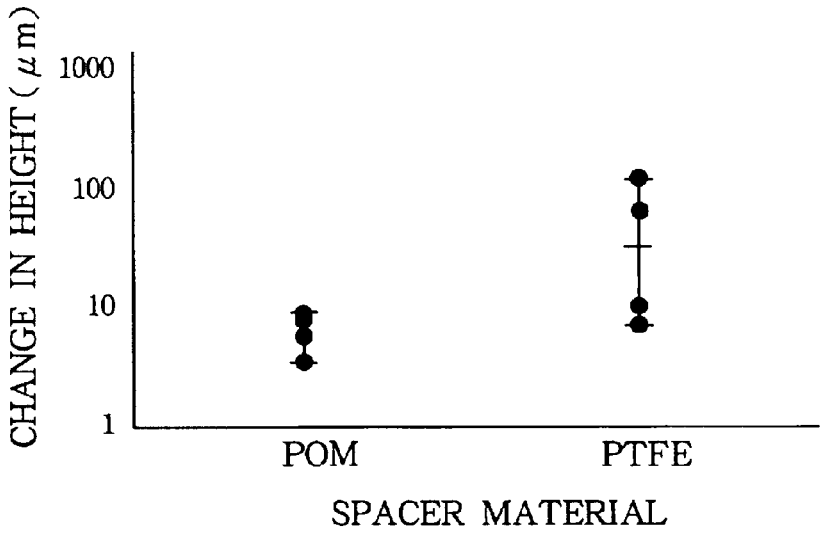
FIG. 9 illustrates the results of an experiment in which investigation was made to determine amounts of wear of spacers when the spacers of different materials are used for a predetermined time period.

FIG. 9 illustrates the results of an experiment in which investigation was made to determine amounts of wear of spacers when spacers of different materials are used for a predetermined time period.

There are two types of materials for the spacers 51*a* and 51*b*: polyacetal that is general purpose engineering plastics and PTFE resin that is a special purpose engineering plastics. The surface material of the photoconductive drum 6 is formed of a layer of plolycarbonate resin. As shown in FIG. 9, the spacers 51*a* and 51*b* formed of polyacetal (POM) having a modulus of elasticity of $4\times10^3$ kg/cm$^2$ showed a change of about 10 μm in height after 40,000 pages have been printed. The spacers 51*a* and 51*b* formed of PTFE resin having a modulus of elasticity of $3.5\times10^3$ kg/cm$^2$ showed changes in a wide range, i.e., 10 to 120 μm. The photoconductive drum 6 was also damaged noticeably. The tolerance of the distance Li between the light exiting end of the SLA 2 and the surface of the photoconductive drum 6 is Lo±50 μm. The wear of the spacers 51*a* and 51*b* formed of PTFE resin is out of this tolerance. The wear of the spacers 51*a* and 51*b* formed of polyacetal resin is about 10 μm at the most, which is sufficiently practical taking into account manufacturing variations and expansion and contraction of the material due to environmental changes. While practical results were obtained from the spacers 51*a* and 51*b* formed of polyacetal resin, the materials and shapes (curvature of the surface in contact with the photoconductive drum, and thickness at the middle of the spacer) are arbitrary conditions selected in this experiment. These conditions are only exemplary and may change depending on the urging force of the spring that urges the LED head, the width of the surface in contact with the photoconductive drum 6, and the material with which the spacers 51*a* and 51*b* are brought into contact.

In the second embodiment, the spacers 51*a* and 51*b* have resiliency in their middle portions, the surfaces of the spacers can be in intimate contact with the surface of the photoconductive drum 6. Thus, wear of the surfaces of the spacers 51*a* and 51*b* and photoconductive drum 6 is minimized and the toner is prevented from entering the gap between the spacers and the photoconductive drum 6. Thus, the structure provides an apparatus in which when the LED head is assembled to the apparatus, the distance Li between the light exiting end of the SLA 2 and the surface of the photoconductive drum 6 do not vary over a wide range.

Third Embodiment

A third embodiment is characterized in that spacers, which determine the distance Li between the light exiting end of the SLA 2 and the photoconductive drum 6, is not provided on the LED head side but on the ID unit side to which the photoconductive drum 6 is mounted.

Figure 10:
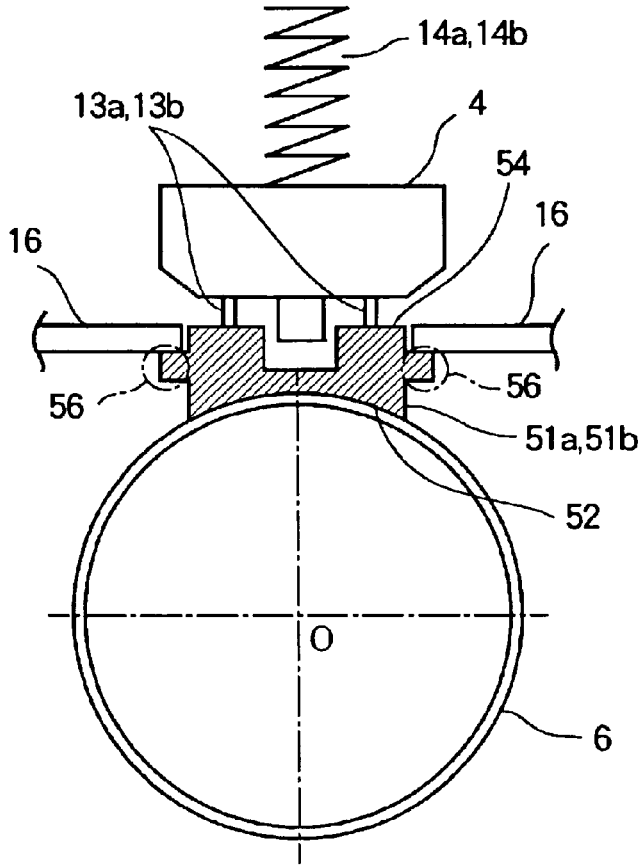
FIG. 10 is a side view of the pertinent portion of a third embodiment.

FIG. 10 is a side view of the pertinent portion of the third embodiment.

Figure 11:
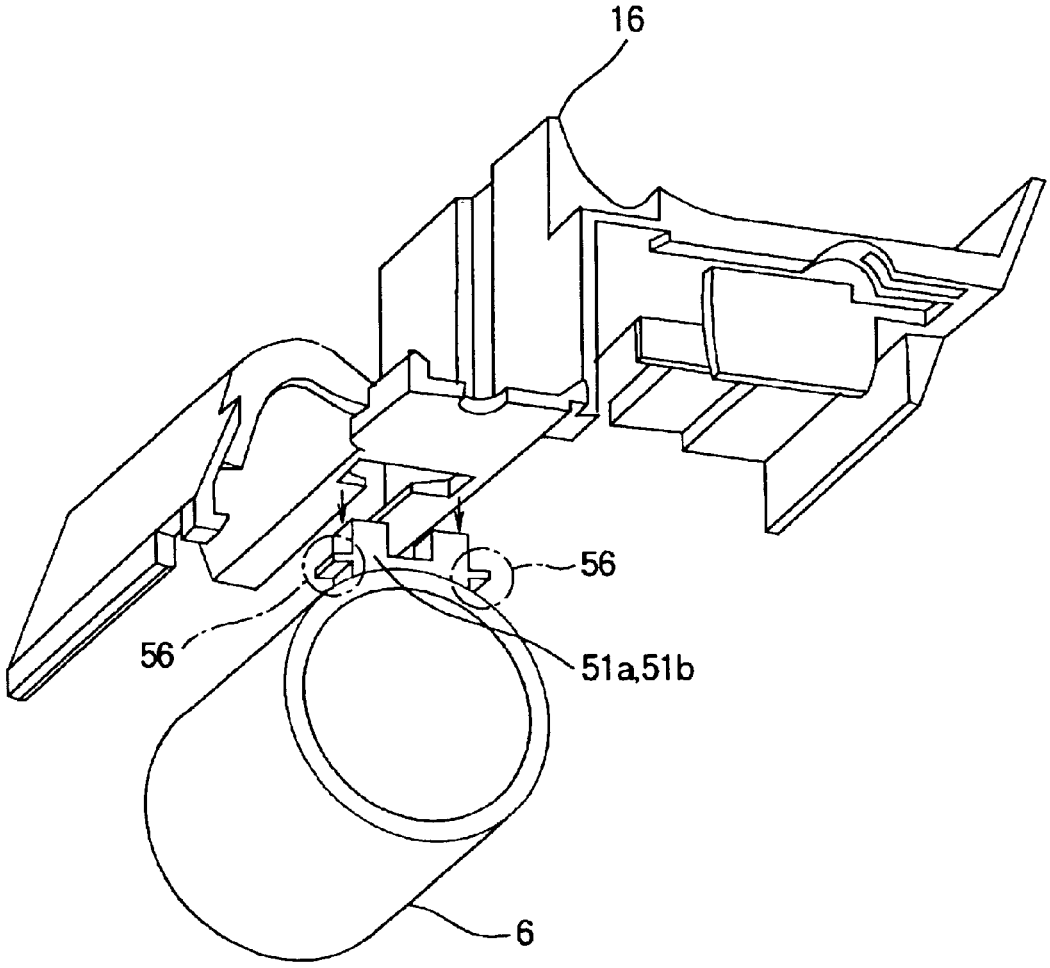
FIG. 11 illustrates an ID unit of the third embodiment.

FIG. 11 illustrates an ID unit of the third embodiment.

The spacers 51*a* and 51*b* have abutting surfaces 52 having substantially the same curvature as the cylindrical photoconductive drum 6. The abutting surface 52 abuts the surface of the photoconductive material of the photoconductive drum 6. The adjusting mechanisms 13*a* and 13*b* are provided to abut the surface 54 on the side opposite from the surface 52. The adjusting mechanisms 13*a* and 13*b* serve to precisely adjust the distance Li so that Li=Lo. The springs 14*a* and 14*b* are mounted on longitudinal top end portions and urge the SLA holder 4 toward the photoconductive drum 6. The spacers 51*a* and 51*b* have short projections 56. The short projections 56 engage the upper frame 16, thereby positioning the spacers 51*a* and 51*b* with respect to the photoconductive drum 6 to prevent the spacers from swinging above the photoconductive drum 6 or coming off due to vibration exerted thereon during transportation.

Figure 12:
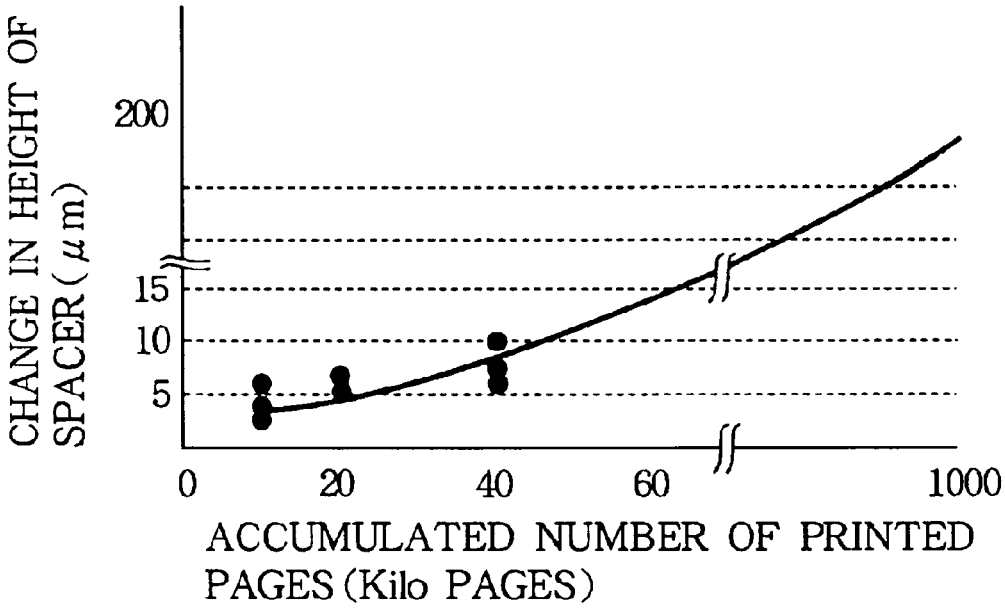
FIG. 12 is a graph of the accumulated number of printed pages versus the change in height of the spacers.

FIG. 12 is a graph of the accumulated number of printed pages versus the change in height of the spacers 51*a* and 51*b*.

The surfaces 52 of the spacers 51*a* and 51*b* have substantially the same curvature as the photoconductive drum 6. During printing, the surfaces of the spacers 51*a* and 51*b* and photoconductive drum 6 are in area contact with each other through sliding friction. The degree of wear of a member is usually considered proportional to the distance over which the member slides on other member, provided that the member slides on the other member with a constant pressure (N/cm2) and at a constant speed (mm/s). As shown in FIG. 12, the accumulated number of printed pages increases 10,000, 20,000, and then 40,000 pages, the rate of change of height of the spacer increases in proportion to the accumulated number of printed pages. The usable lifetime of the apparatus was 1,000,000 pages and the designed lifetime of the LED head is substantially the same as that of the apparatus. This implies that the spacers on the LED head side should have as long a lifetime as 1,000,000 pages. However, as is clear form FIG. 12, if the apparatus operates up to 1,000,000 pages, the heights of the spacers will have changed by several hundred microns. The tolerance of the distance Li is Lo=±50 μm. Therefore, it is apparent that if the apparatus is operated until it reaches the end of its lifetime, the distance Li cannot be maintained within the tolerance. Usually, an ID unit in which a photoconductive drum is incorporated is a consumable item that is replaced by a new, unused one at regular intervals. The ID unit used in the experiment is of design in which the ID unit is replaced after the accumulated number of printed pages reach 40,000 pages. FIG. 12 shows that when an accumulated number of printed pages reaches 40,000 pages, the amount of wear of the spacer is less than 10 μm. The amount of wear is sufficiently practical within a period between replacement.

In the third embodiment, the spacers are provided on the ID unit side. This implies that replacement of the ID automatically replaces the spacers by new, unused ones. Thus, the distance Li between the light exiting end of the SLA and the surface of the photoconductive drum 6 can be maintained constant until the apparatus reaches the end of its lifetime, thereby providing stable print quality.

Fourth Embodiment

A fourth embodiment is characterized in that the spacers provided on longitudinal ends of the photoconductive drum 6 are outside of a surface area of the photoconductive drum 6 that is in contact with a charging roller.

Just as in the first and second embodiments, the spacers may be provided on the LED head side. Alternatively, the spacers may be provided on the ID unit side just as in the third embodiment. When the spacers are provided on the LED head side, the spacers may be secured to the LED head just as in the first embodiment, or may simply abut the LED head.

Figure 13:
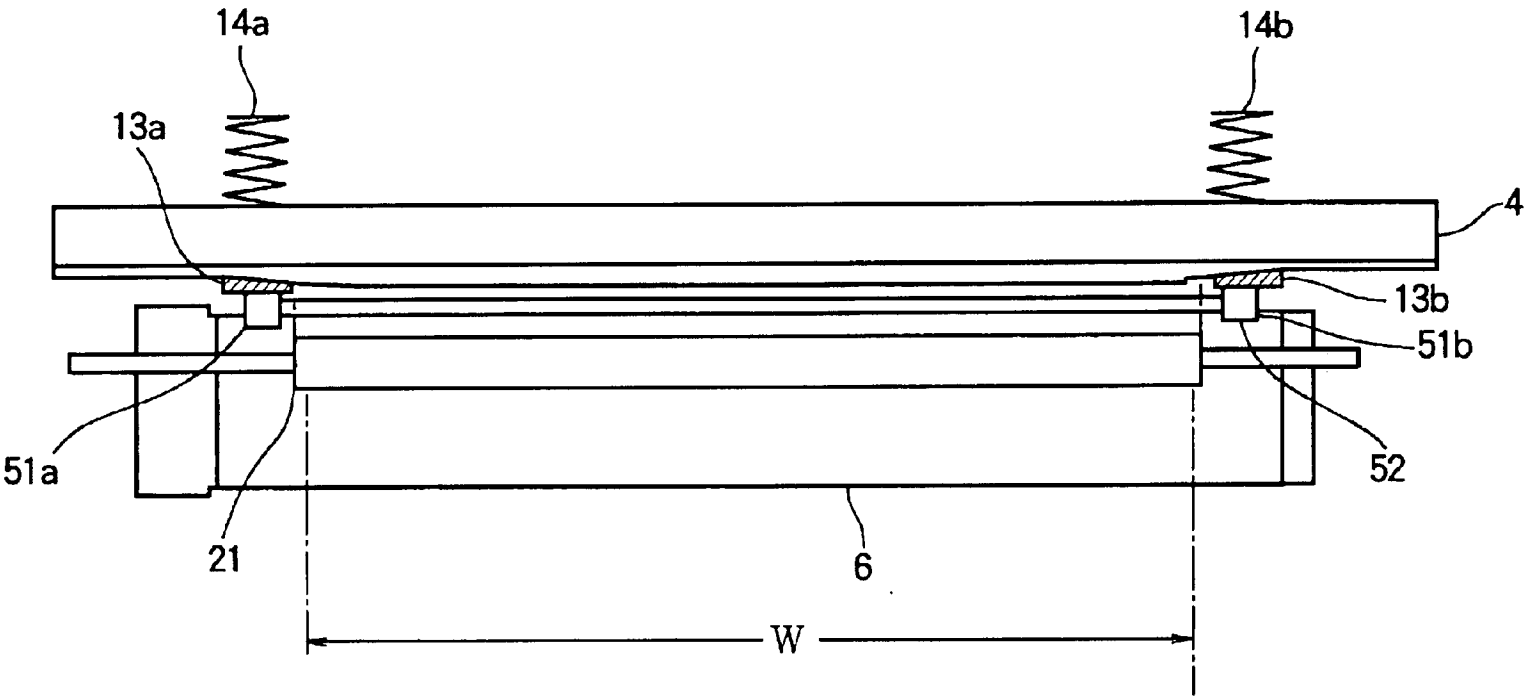
FIG. 13 is a front view of a fourth embodiment.

FIG. 13 is a front view of the fourth embodiment.

The surfaces 52 of the spacers 51*a* and 51*b* have substantially the same curvature as the surface of the photoconductive drum 6. The surfaces 52 abut the surface of the photoconductive drum 6. The adjusting mechanism 13*a* (13*b*) is secured to or simply abuts the surface of the spacer 51*a* (51*b*) on the opposite side of the recessed abutting surface 52. The adjusting mechanisms 13*a* and 13*b* are adjusted so that Lo=Li. The springs 14*a* and 14*b* are mounted on opposed longitudinal end portions of the SLA holder 4 and urge the SLA holder 4 toward the photoconductive drum 6 through spacers 15*a* 15*b*.

Figure 14:
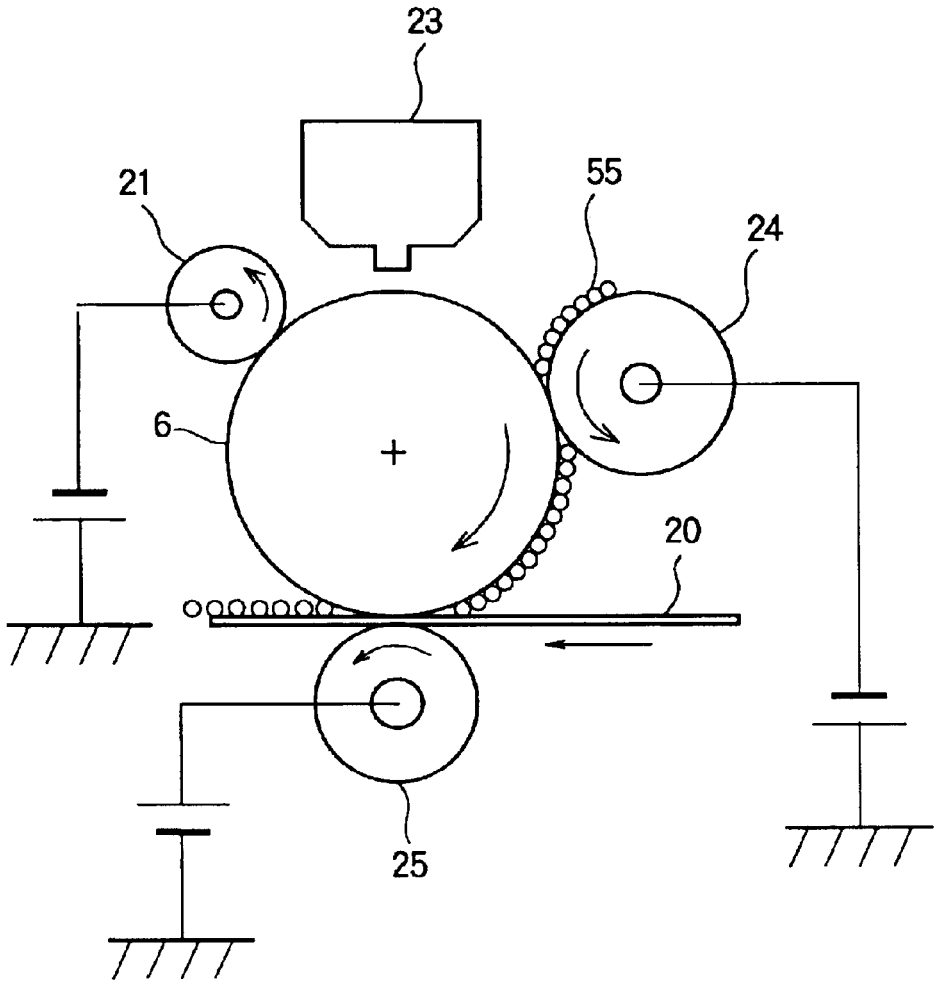
FIG. 14 illustrates the arrangement of the respective rollers in the ID unit.

FIG. 14 illustrates the arrangement of the respective rollers in the ID unit.

The photographic process of the photographic printer will be described briefly with reference to FIG. 14. The photographic process includes charging, exposing, developing, and transferring. These steps are sequentially carried out to print on the print paper. During charging, the charging roller 21 receives a high voltage so that the charging roller 21 uniformly charges the photoconductive drum 6 with negative charges. During exposing, the LED head 23 illuminates the charged surface of the photoconductive drum 6 to selectively dissipate the charges in accordance with print data. The potential of illuminated areas decreases while that of non-illuminated areas remains negatively high. Therefore, the illuminated areas and non-illuminated areas form an electrostatic latent image as a whole. This electrostatic latent image advances to the developing roller 24 as the photoconductive drum 6 rotates. During developing, toner is deposited on the electrostatic latent image to develop the electrostatic latent image into a toner image. The toner is charged due to the friction between the developing roller 24 and a developing blade, not shown. The charged toner migrates by the Coulomb force to the photoconductive drum 6 in the electric field developed due to the potential difference between the developing roller 24 and the photoconductive drum 6, so that the toner particles are deposited on the electrostatic latent image to form a toner image. During transferring, the transfer roller 25 receives a positive voltage to negatively charge the back side of the print paper 20, so that the negatively charged toner 55 on the photoconductive drum 6 is transferred by the Coulomb force to the print paper 20.

If, for some reason, hard foreign matters enter the ID unit from outside and penetrates the photoconductive material to reach the core tube of the photoconductive drum 6, leakage may occur across the photoconductive drum 6 and the charging roller 21 that receives a high voltage. Even if leakage does not occur, a damage deep in the photoconductive material on the photoconductive drum 6 prevents the drum surface from being properly charged so that the toner charged on the developing roller 24 migrates from the developing roller 24 to the photoconductive drum 6. The toner 65 migrated to the surface of the photoconductive drum 6 falls between the charging roller 21 and the photoconductive drum 6 to be rubbed therebetween, and the rubbed toner migrates to the charging roller 21 as well. If excessive toner is deposited on the charging roller 21, the surface of the charging roller 21 becomes away from the surface of the photoconductive drum 6 by the thickness of the deposited toner layer. As a result, the toner is deposited over a wide area of the surface of the photoconductive drum 6 so that the toner 55 causes soiling of the surface of the photoconductive drum 6.

In the invention, the spacers 51*a* and 51*b* are disposed outside of an area W in which the charging roller 21 rotates in contact with the photoconductive drum 6. Therefore, even if the spacers 51*a* and 51*b* cause a scratch deep in the surface of the photoconductive drum 6, the scratch does not cause the toner 55 to migrate to the charging roller 21 and will not affect print quality.

Fifth Embodiment

The apparatus according to the fourth embodiment tends to be of large size because the spacers are disposed outside of the area in which the charging roller 24 rotates in contact with the photoconductive drum 6. A fifth embodiment provides a structure that offers the same advantages as the fourth embodiment while also maintaining the same overall size of the apparatus.

Figure 15:
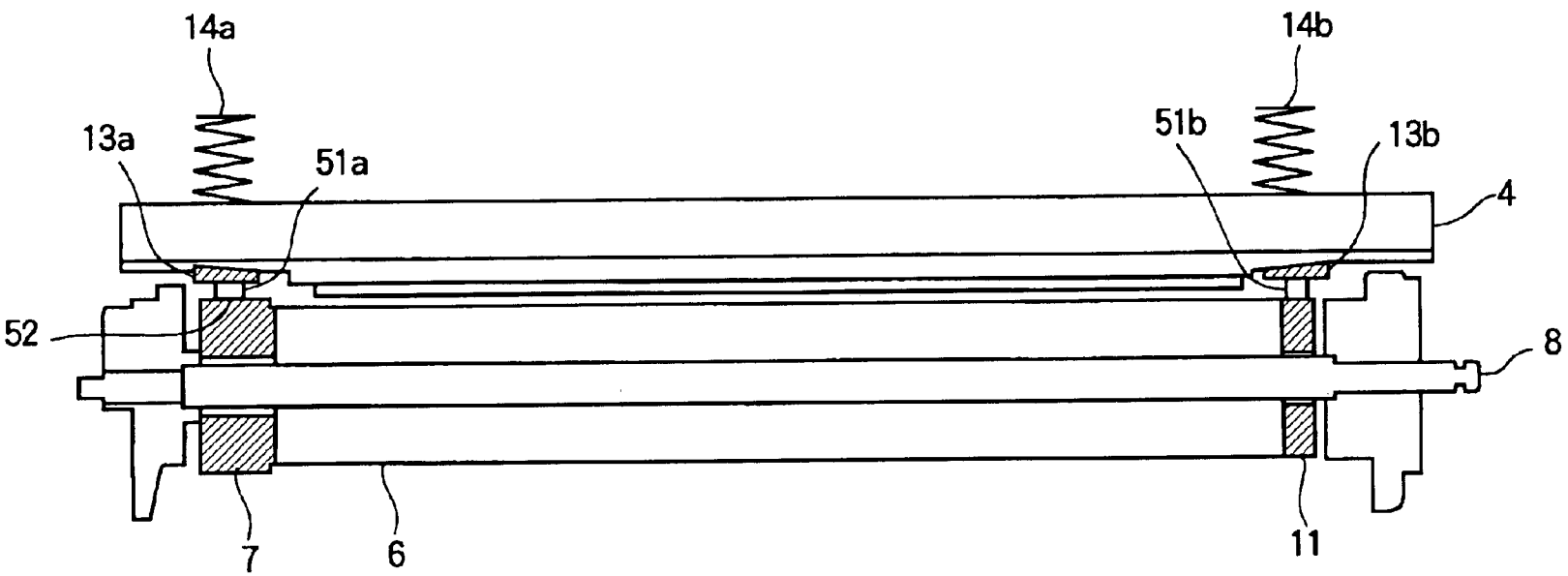
FIG. 15 is a front view of an apparatus according to a fifth embodiment.

FIG. 15 is a front view of an apparatus according to the fifth embodiment.

The photoconductive drum 6 is generally cylindrical. The spacers 51*a* and 51*b* have recessed abutting surfaces 52. The abutting surface 52 of the spacer 51*a* is in sliding contact with a gear 7 provided at one longitudinal end portion of the photoconductive drum 6. The abutting surface 52 of the spacer 51*b* is in sliding contact with a flange 11 provided at the other longitudinal end portion of the photoconductive drum 6. The spacers 51*a* and 51*b* may be disposed on the LED head side just as in the first embodiment or on the ID unit side to which the photoconductive drum 6 is attached just as in the third embodiment. If the spacers 51*a* and 51*b* are disposed on the LED side, they may be secured to the SLA holder 4 just as in the first embodiment or may simply abut the LED head. The gear 7 takes the form of a bevel gear and is driven in rotation by a drive source, not shown, thereby driving the photoconductive drum 6 in rotation. The gear 7 and flange 11 have holes in their centers through which the rotational shaft of the photoconductive drum 6 extends. The flange 11 is in the shape of a disk and is in line with the photoconductive drum 6. Adjusting mechanisms 13*a* and 13*b* simply abut or are secured on the surfaces of the spacers 51*a* and 51*b* opposite from the abutting surfaces 52. The adjusting mechanisms 13*a* and 13*b* are operated such that Li=Lo. The springs 14*a* and 14*b* mounted on longitudinal ends of the SLA holder 4 urge the SLA holder 4 toward the photoconductive drum 6. The aforementioned structure does not cause the spacers 51*a* and 51*b* to scratch the surface of the photoconductive drum 6, thereby preventing the soiling of the print paper just as in the fourth embodiment.

Sixth Embodiment

Figure 16:
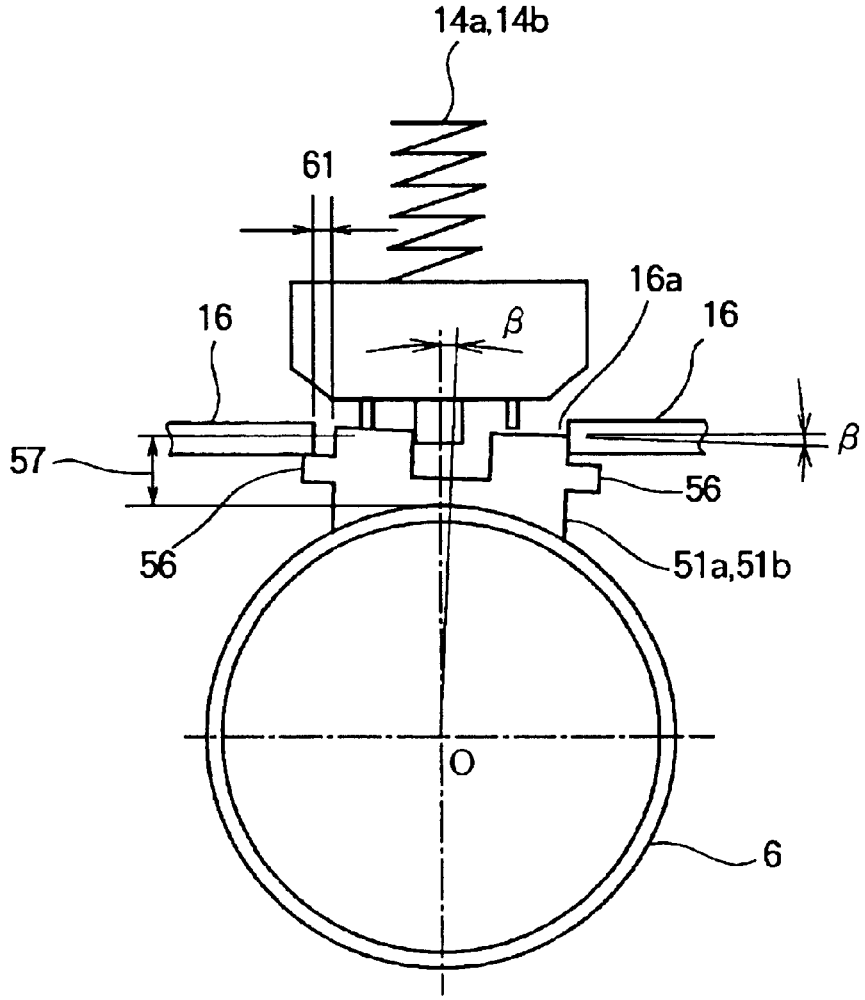
FIG. 16 illustrates a problem that a sixth embodiment is to solve.

FIG. 16 illustrates a problem addressed by a sixth embodiment. If the spacers 51*a* and 51*b* have flat surfaces that abut the adjusting mechanisms 13*a* and 13*b*, then the frame 16 is formed with holes 16*a* into which upper projected portions of the spacers enter. The hole 16*a* is somewhat larger than the upper projected portions such that when the upper projected portion enters the hole 16*a*, there is a gap 61 between the upper projected portion and the frame 16 that defines the hole 16*a*. The holes 16*a* allow the spacers 51*a* and 51*b* to smoothly displace relative to the upper frame 16 when the springs 14*a* and 14*b* urge the spacers 51*a* and 51*b*. However, the holes 16*a* may also cause the spacers 51*a* and 51*b* to be oriented at an angle $\pm\beta$ with the vertical line passing through a center O of the photoconductive drum 6. This angular deviation also causes the abutting surfaces 54 of the spacers 51*a* and 51*b* to be at an angle with a horizontal plane, resulting in a change in the height of the adjusting mechanisms 13*a* and 13*b*. Thus, the inclined orientation of the spacers 51*a* and 51*b* at an angle with the vertical line passing through a center O of the photoconductive drum 6 causes the distance Li to change, so that Li is no longer equal to Lo. A further problem is the inclination of the LED head.

Figure 17:
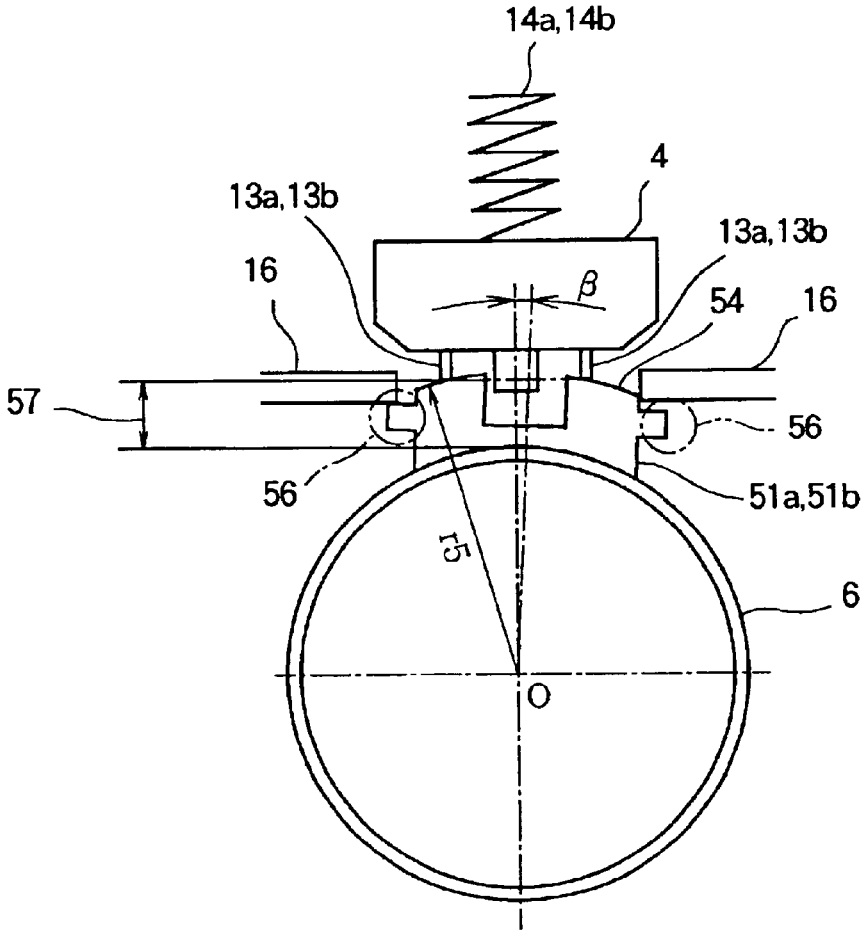
FIG. 17 is a side view illustrating the sixth embodiment.

FIG. 17 is a side view illustrating the sixth embodiment.

The spacers according to the sixth embodiment are not mounted on the LED head side but on the ID side. The sixth embodiment is characterized in that the abutting surface 54 of the spacer 51*a* (51*b*) that abuts the adjusting mechanism 13*a* (13*b*) is a curved surface having a curvature r5. In other words, the curved surface is concentric to the photoconductive drum 6. The same elements as the first to fifth embodiments have been given the same reference numerals and only a portion different from the first to fifth embodiments will be described.

The spacers 51*a* and 51*b* have short projections 56. The projections 56 engage the upper frame 16, thereby positioning the spacers 51*a* and 51*b* with respect to the photoconductive drum 6 so that the spacers 51*a* and 51*b* are prevented from swinging above the photoconductive drum 6 or coming off the photoconductive drum 6 during transportation. The height 57 of the spacers 51*a* and 51*b* with respect to the surface of the photoconductive drum 6 will not change even if the spacers 51*a* and 51*b* are urged in a direction at an angle $\beta$ with a vertical line passing through the center O of the photoconductive drum 6, or the height of any part of the spacers 51*a* and 51*b* with respect to the photoconductive drum 6 remain unchanged. Thus, the distance Li between the light exiting end of the SLA 2 and the surface of the photoconductive drum 6 is maintained constant reliably.

Seventh Embodiment

Figure 18:
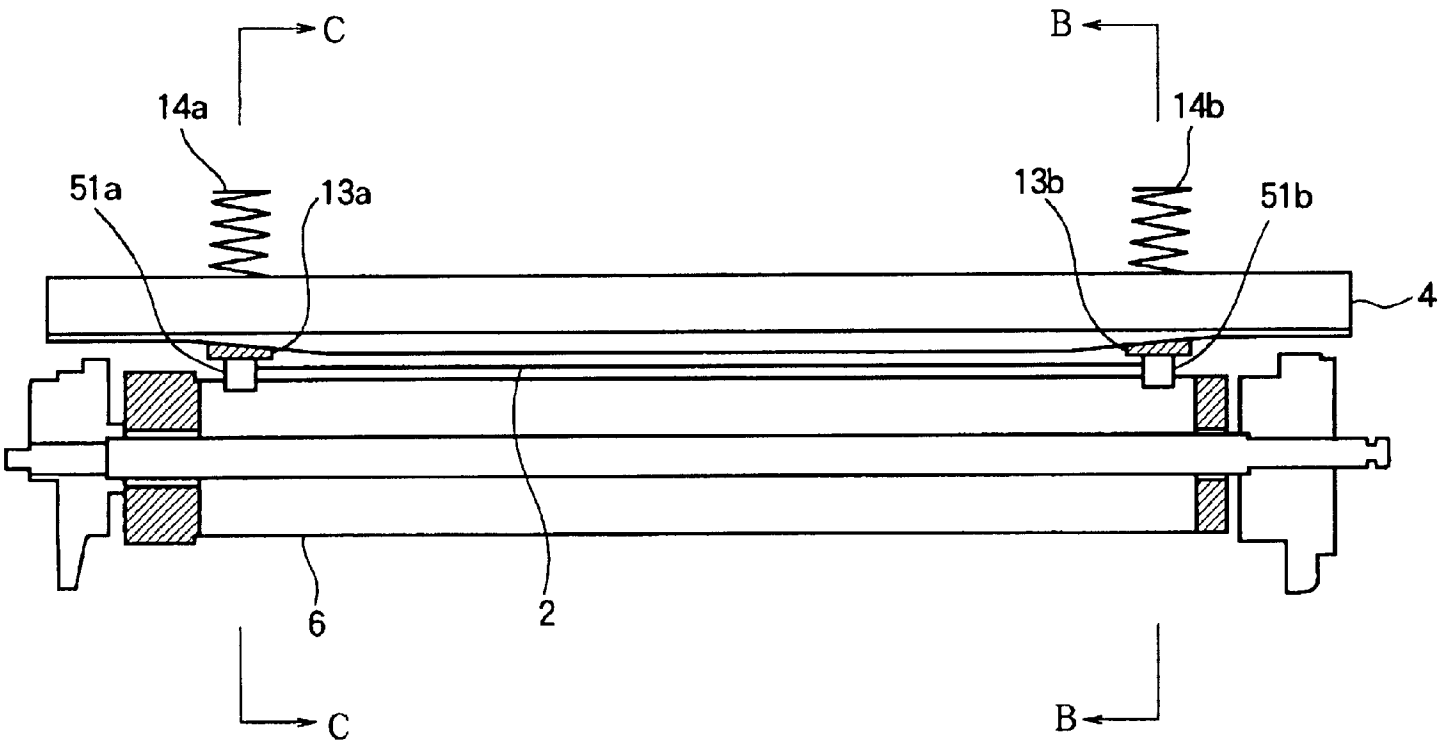
FIG. 18 is a front view of a structure according to the sixth embodiment.

FIG. 18 is a front view of a structure according to the sixth embodiment. The spacers 51*a* and 51*b* are disposed at longitudinal end portions of the photoconductive drum 6 and slides in contact with the surface of the photoconductive drum 6. The adjusting mechanisms 13*a* and 13*b* are disposed on the spacers 51*a* and 51*b*. The SLA holder 4 is disposed on the adjusting mechanisms 13*a* and 13*b*. The springs 14*a* and 14*b* urge the SLA holder 4 toward the photoconductive drum 6 in such a way that the adjusting mechanisms 13*a* and 13*b* abut at a total of four locations to firmly position the LED head with respect to the photoconductive drum 6. By the use of the adjusting mechanisms 13*a* and 13*b*, the distance Li between the light exiting surface of the LED head and the photoconductive drum 6 can be accurately set.

Figure 19:
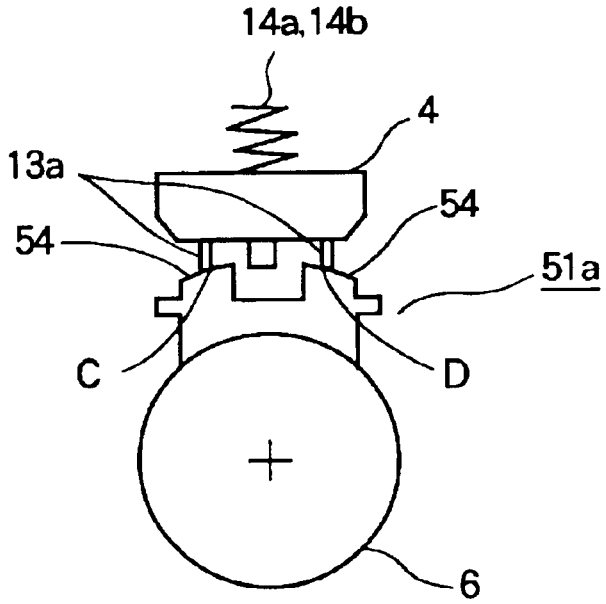
FIG. 19 is a cross-sectional view taken along the line C—C of FIG. 18.

FIG. 19 is a cross-sectional view taken along the line C—C of FIG. 18.

Figure 20:
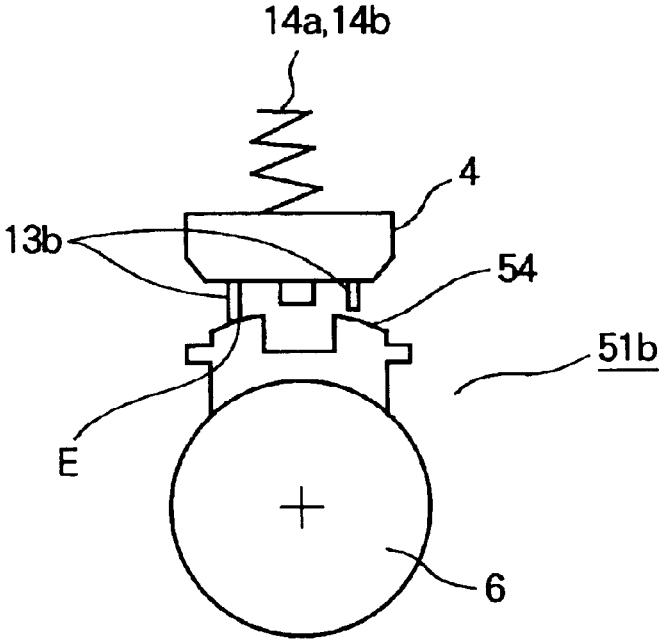
FIG. 20 is a cross-sectional view taken along the line B—B of FIG. 18.

FIG. 20 is a cross-sectional view taken along the line B—B of FIG. 18.

A structure where the SLA holder 4 is supported at four locations suffers from the following problem. For example, while the adjusting mechanisms 13*a* and 13*b* are designed to be of the same length or height, they cannot be exactly the same in reality. In other words, the four bottom portions are of slightly different height due to manufacturing error as shown in FIGS. 19 and 20.

Figure 21:
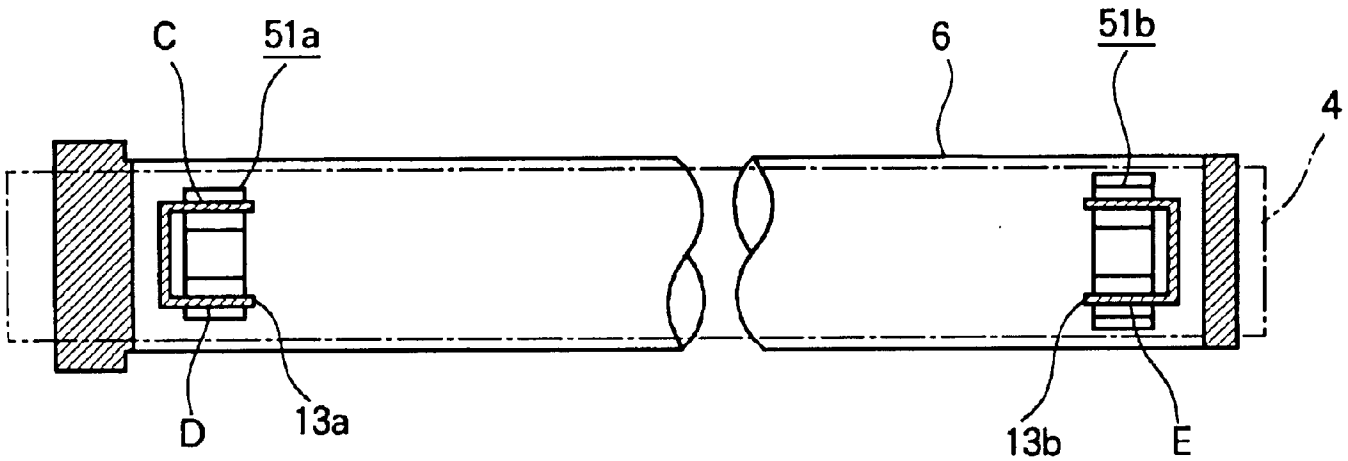
FIG. 21 is a top view of the adjusting mechanisms when the adjusting mechanisms are disposed on the longitudinal end portions of the SLA holder and abut the spacers.

FIG. 21 is a top view when the adjusting mechanisms disposed on the longitudinal end portions of the SLA holder abut the spacers, respectively.

As shown in FIGS. 19–21, the spacers 51*a* and 51*b* abut three bottoms (e.g., locations C, D, and E) of the adjusting mechanisms 13*a* and 13*b* whose lengths match one another. One remaining bottom does not abut the spacer. Actually, the two springs 14*a* and 14*b*, are disposed at longitudinal end portions of the SLA holder 4, and urge the SLA holder 4 in slightly different directions from each other. Therefore, the spacers 51*a* and 51*b* do not necessarily receive the same three bottoms of the adjusting mechanisms 13*a* and 13*b*. This implies that the LED head cannot be held reliably relative to the photoconductive drum 6 to ensure that Li=Lo at all times.

Thus, the seventh embodiment solves the aforementioned problem, thereby holding the LED head with respect to the photoconductive drum 6 such that Li=Lo at all times. The seventh embodiment uses eccentric cam mechanisms 60 and 61 in place of the adjusting mechanisms 13*a* and 13*b*.

Figure 22:
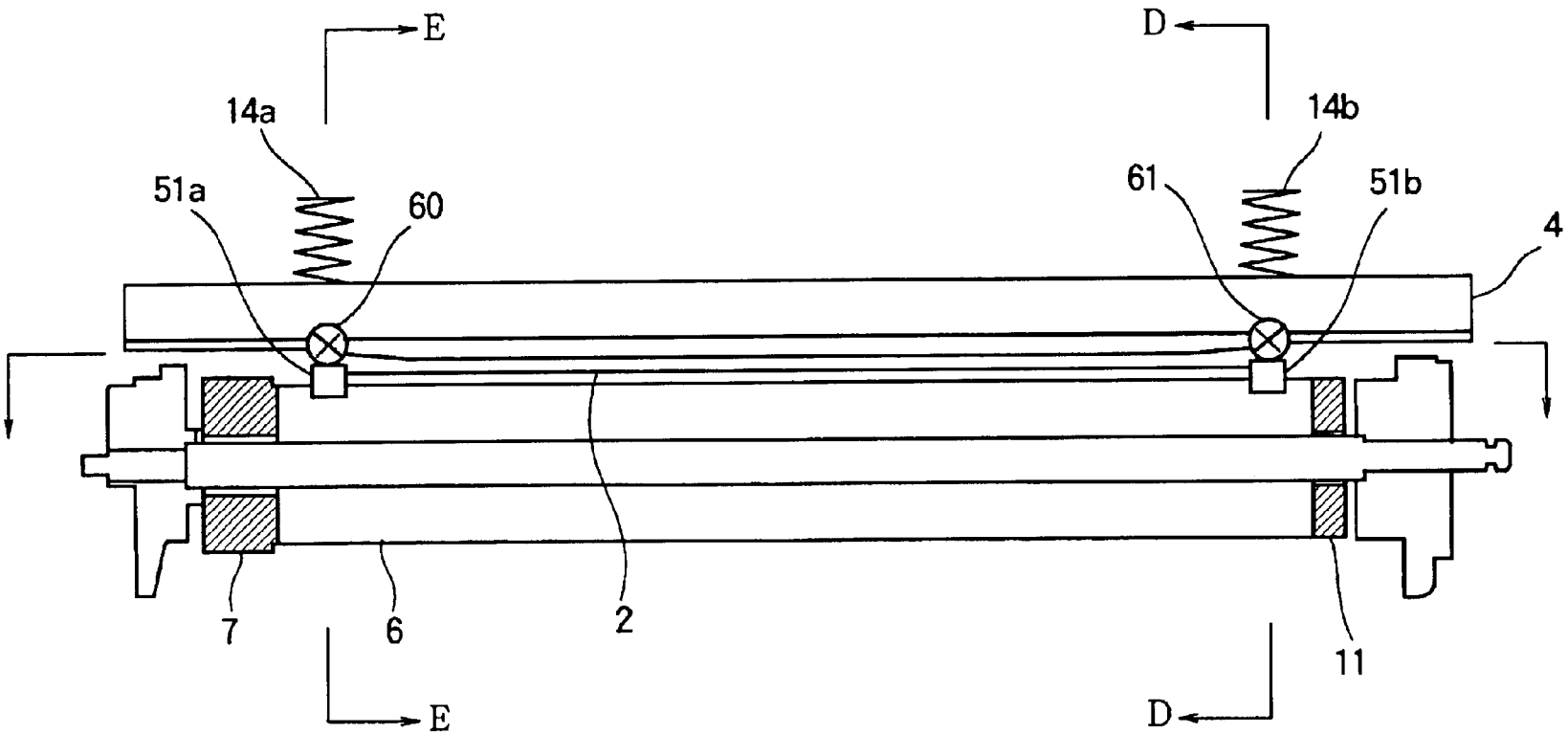
FIG. 22 is a front view of a pertinent portion of a seventh embodiment.

FIG. 22 is a front view of a pertinent portion of the seventh embodiment.

Figure 23:
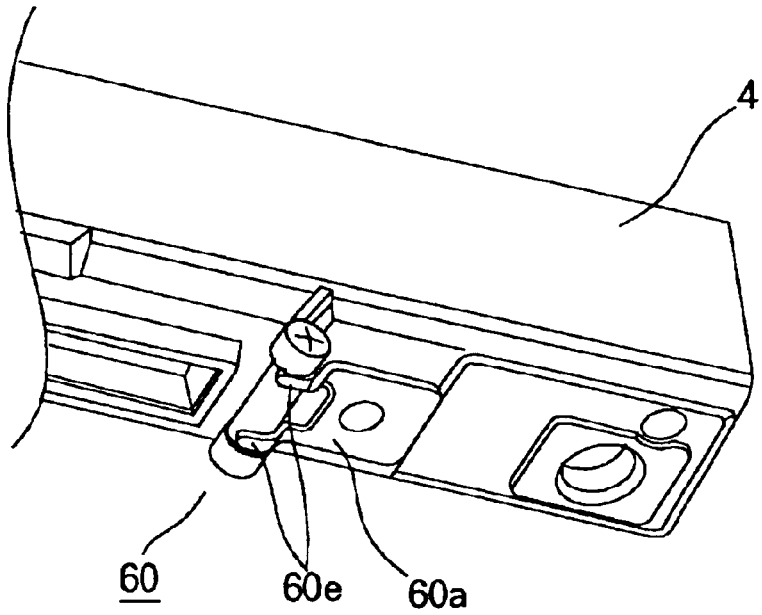
FIG. 23 is a perspective view of an eccentric cam mechanism, looking upward from the photoconductive drum.

FIG. 23 is a perspective view of the eccentric cam mechanism 60, looking upward from the photoconductive drum 6.

Figure 24:
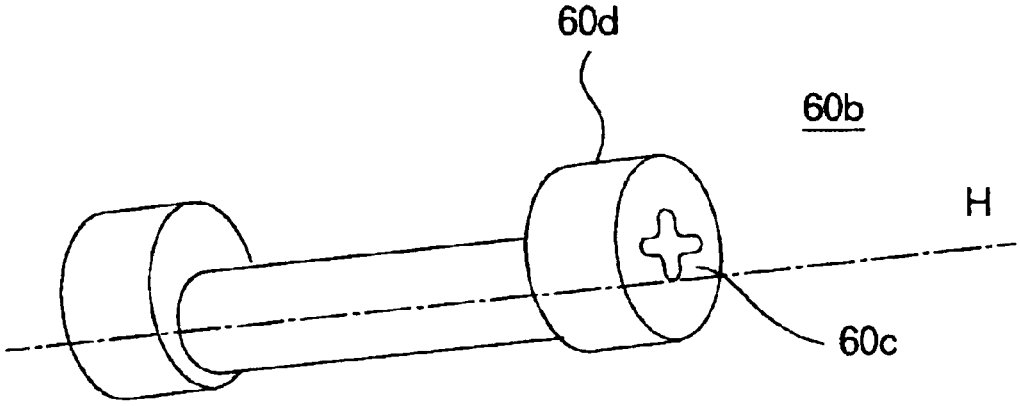
FIG. 24 illustrates a cam portion of the eccentric cam mechanism.

FIG. 24 illustrates a cam portion 60*a* of the eccentric cam mechanism 60.

Figure 25:
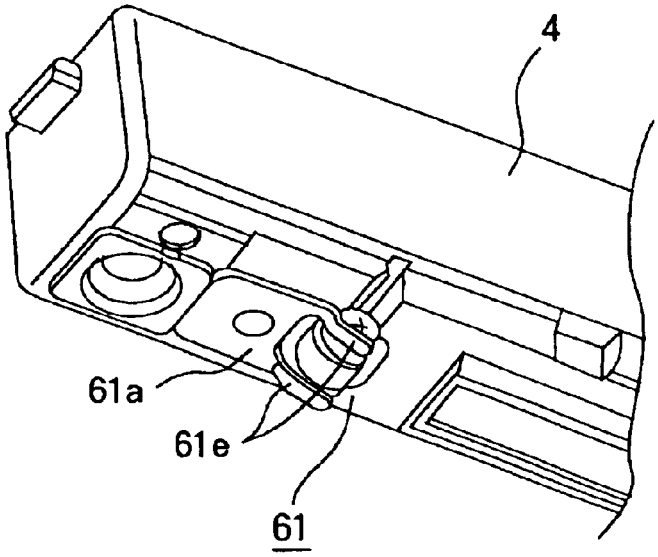
FIG. 25 is a perspective view of the eccentric cam mechanism, looking upward from the photoconductive drum.

FIG. 25 is a perspective view of the eccentric cam mechanism 61, looking upward from the photoconductive drum 6.

Figure 26:
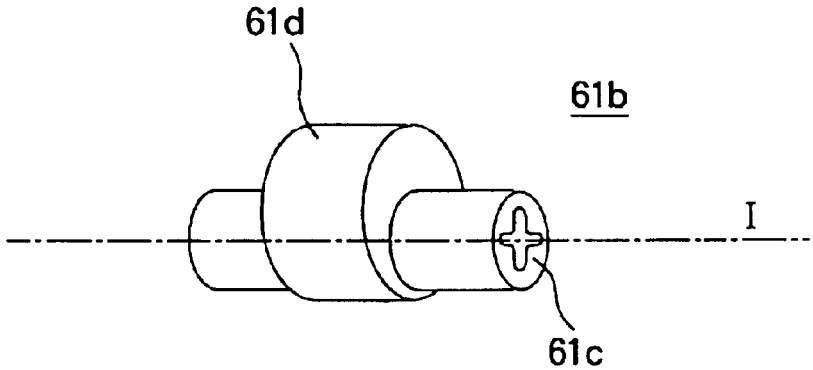
FIG. 26 illustrates a cam portion of the eccentric cam mechanism.

FIG. 26 illustrates a cam portion 61*a* of the eccentric cam mechanism 61.

The eccentric cam mechanisms 60 and 61 are disposed at longitudinal end portions of the LED holder 4. The cam portion 60*a* is firmly rotatably held against the SLA holder 4 by two fingers 60*e* of a retainer 60*a*. The cam portion 60*a* is formed with a cross-shaped groove 60*c* into which a Phillips screwdriver is inserted. Driving the groove 60*c* with the screwdriver causes the cam portion 60*d* to rotate about an axis H. The cam portion 61*a* is firmly rotatably held against the SLA holder 4 by two fingers 61*e* of a retainer 61*a*. The cam portion 61*a* is formed with a cross-shaped groove 61*c* into which a Phillips screwdriver is inserted. Driving the groove 61*c* with the screwdriver causes the cam portion 61*d* to rotate about an axis I. As mentioned above, driving the grooves 60*c* and 61*c* with a screwdriver allows adjustment of the height of the SLA holder 4 with respect to the spacers. Because the fingers 60*e* and 61*e* firmly hold the eccentric cam mechanisms, the cam portions 60*a* and 61*a* stay where they are adjusted.

Figure 27:
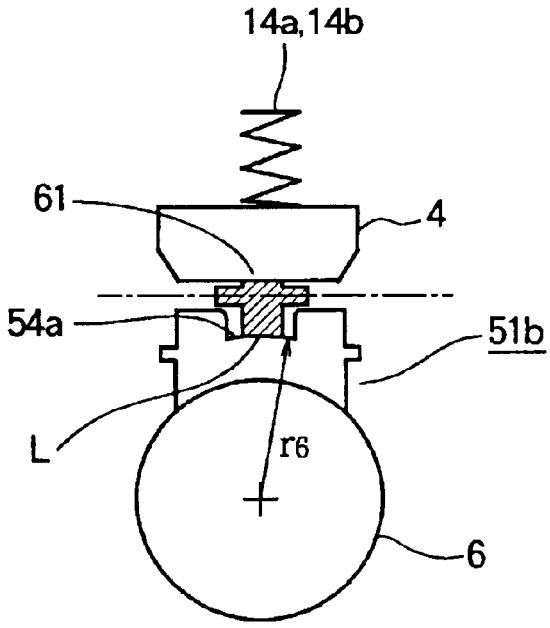
FIG. 27 is a cross-sectional side view taken along the line D—D of FIG. 22.

FIG. 27 is a cross-sectional side view taken along the line D—D of FIG. 22.

Figure 28:
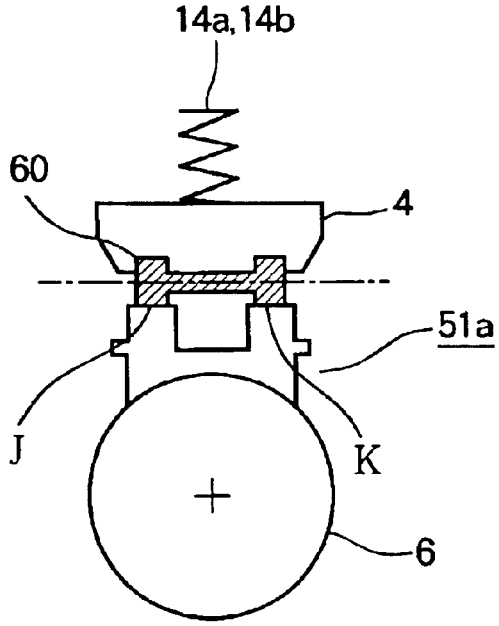
FIG. 28 is a cross-sectional side view taken along the line E—E of FIG. 22.

FIG. 28 is a cross-sectional side view taken along the line E—E of FIG. 22.

Figure 29:
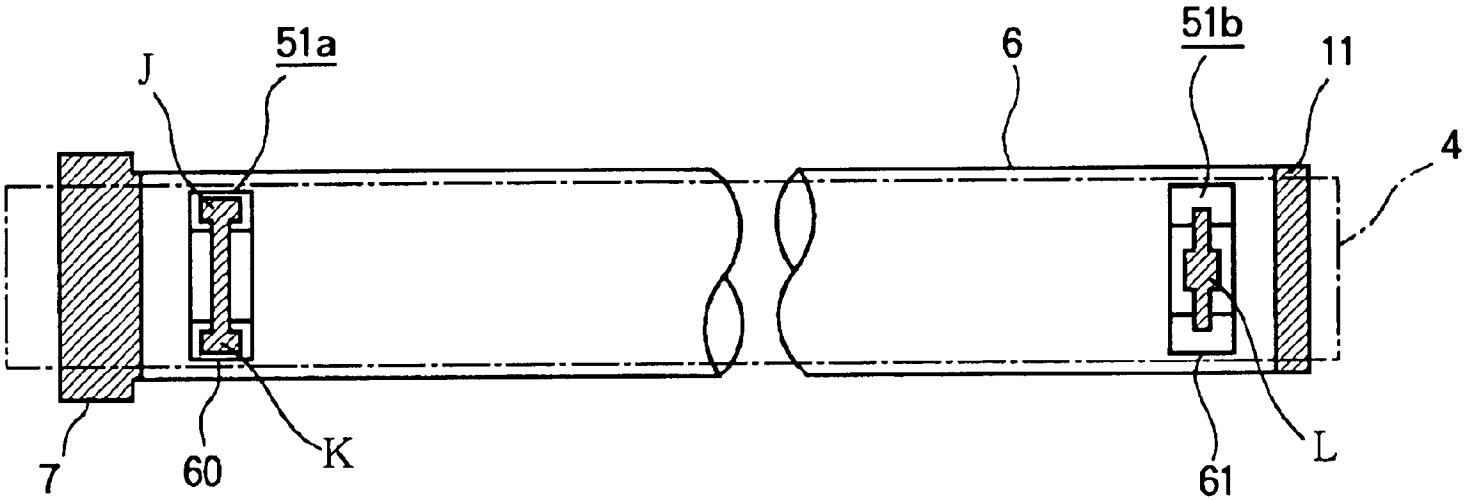
FIG. 29 is a top view of the pertinent portion.

FIG. 29 is a top view of the pertinent portion.

Figure 30:
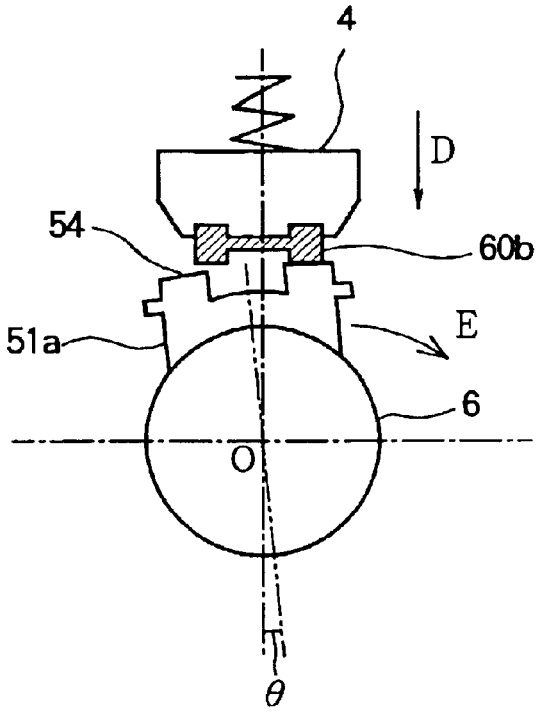
FIG. 30 illustrates the spacer when the spacer is not in a horizontal plane.

FIG. 30 illustrates the spacer when the spacer is not in a horizontal plane.

The spacers 51*a* and 51*b* slide over the surface of the photoconductive drum 6 at longitudinal end portions of the photoconductive drum 6. The SLA holder 4 abuts the top surfaces 54 of the spacers 51*a* and 51*b*. The springs 14*a* and 14*b* are disposed on the SLA holder 4 and urge the SLA holder 4 toward the photoconductive drum 6. The eccentric cam mechanisms 60 and 61 are sandwiched between the spacers 51*a* and 51*b* and the SLA holder 4. Operating the eccentric cam mechanisms 60 and 61 allows adjustment of the distance Li between the light exiting end of the SLA and the photoconductive drum 6 such Li=Lo.

The eccentric cam mechanism 60 abuts two locations J and K on the flat surface 54 of the spacer 51*a* while the eccentric cam mechanism 61 abuts a location L on a curved surface of the spacer 51*b* eccentric to the surface of the photoconductive drum 6. This ensures that the spacer 51*b* is always urged in a direction passing through a rotational axis O of the photoconductive drum 6. Thus, even if the spacer 51*b* is urged in a direction at an angle with the vertical axis passing through the rotational axis O of the photoconductive drum 6, the height of the eccentric cam mechanism 61 with respect to the photoconductive drum 6 will not change.

Therefore, the LED head is held at three locations. As shown in FIG. 30, when the spacer 51*a* is angularly displaced somewhat from its designed position, the flat surface 54 of the spacer makes an angle with a horizontal lane. However, the friction between the spacer 51*a* and the photoconductive drum 6 is very small. Therefore, when the SLA holder 4 descends in a direction shown by arrow D toward the photoconductive drum 6, the bottom portions of the eccentric cam mechanism 60 first abuts a higher portion of the spacer 51*a*. Then, the eccentric cam mechanism 60 pushes down the higher portion, causing the spacer 51*a* to rotate in a direction shown by arrow E such that the flat surface lies in a horizontal plane. As a result, the eccentric cam mechanism 60 abuts two locations on the surface 54 of the spacer 51*a* as shown in FIG. 23.

The seventh embodiment uses the eccentric cam mechanisms 60 and 61 as a mechanism for adjusting the distance Li. The mechanism can be of any type, provided that the height of the SLA holder 4 can be properly adjusted with respect to the photoconductive drum 6.

Eighth Embodiment

An eighth embodiment is characterized in that the spacer has a circumferentially extending groove that is formed in the surface in contact with the photoconductive drum.

Figure 31:
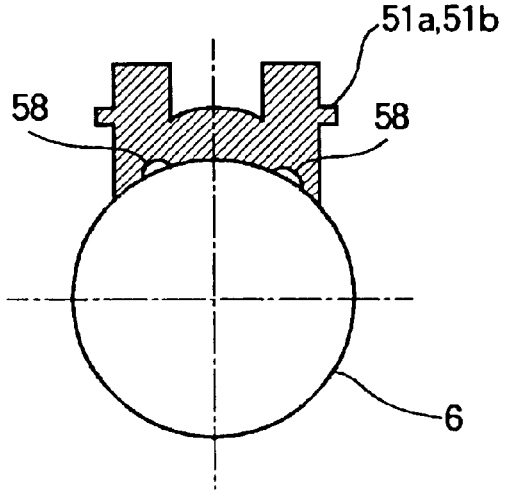
FIG. 31 illustrates sink marks developed in a spacer during the manufacture of the spacer.

FIG. 31 illustrates sink marks developed in a spacer during the manufacture of the spacer.

Figure 32:
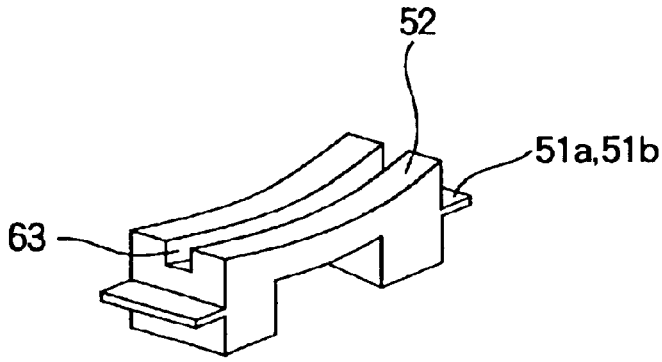
FIG. 32 is a perspective view of the spacer according to an eighth embodiment.

FIG. 32 is a perspective view of the spacer according to the eighth embodiment.

Figure 33:
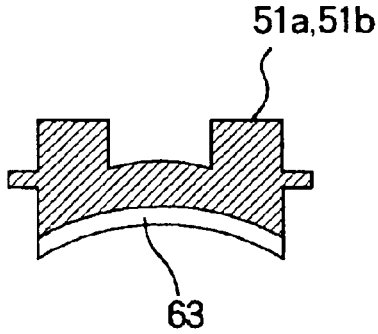
FIG. 33 is a cross-sectional view of the spacer of FIG. 32.

FIG. 33 is a cross-sectional view of the spacer of FIG. 32.

Figure 34:
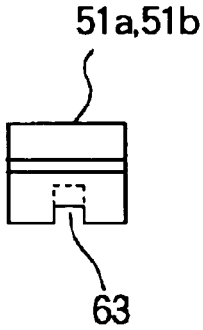
FIG. 34 is a side view of the spacer of FIG. 32.
Figure 35:
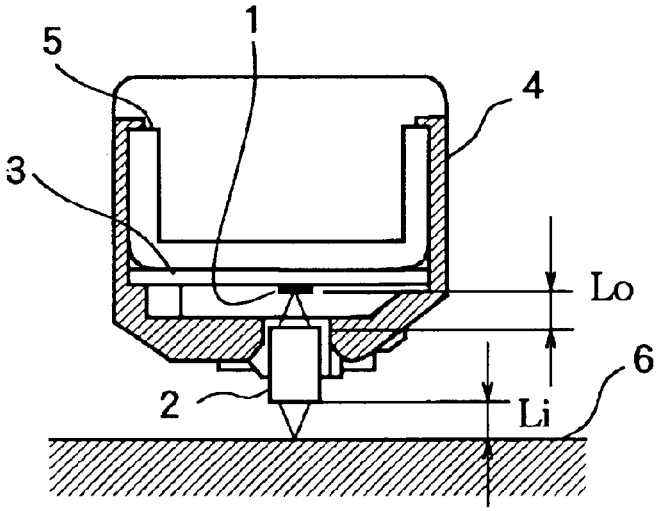
FIG. 35 is a cross-sectional view of a conventional LED head.
Figure 36:
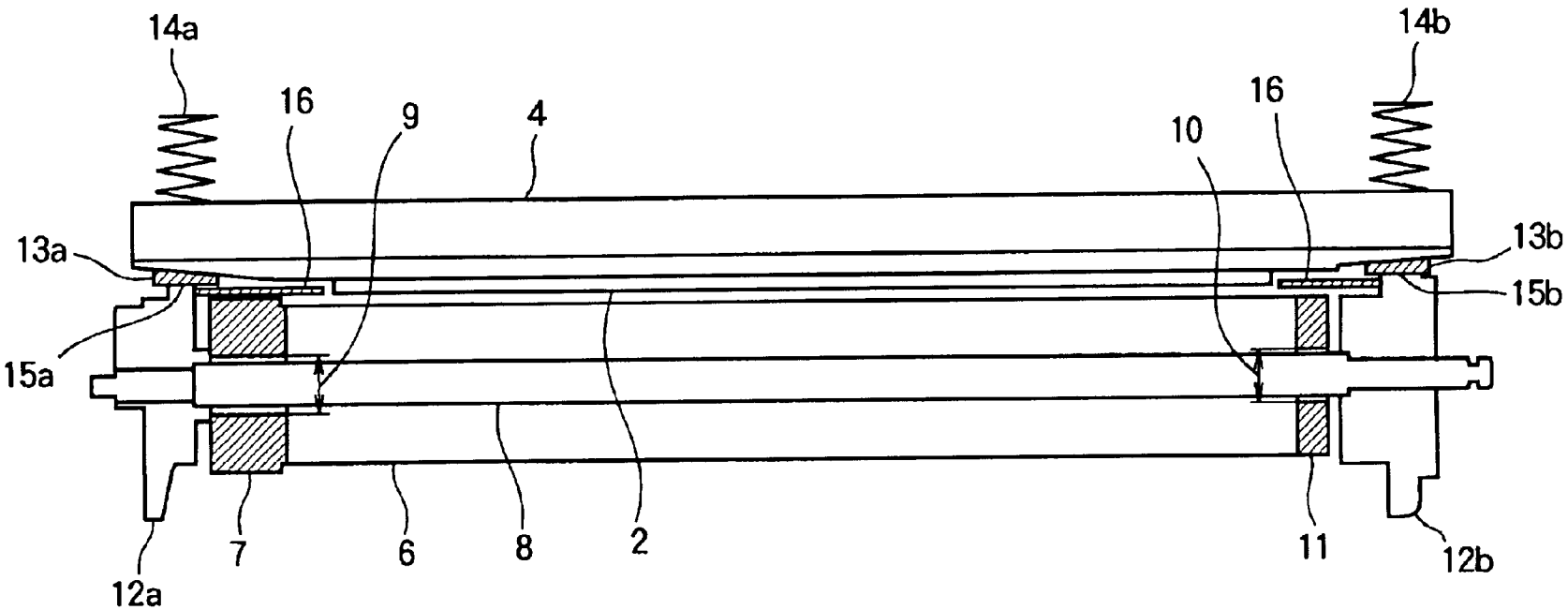
FIG. 36 is a front view of the conventional LED head.
Figure 37:
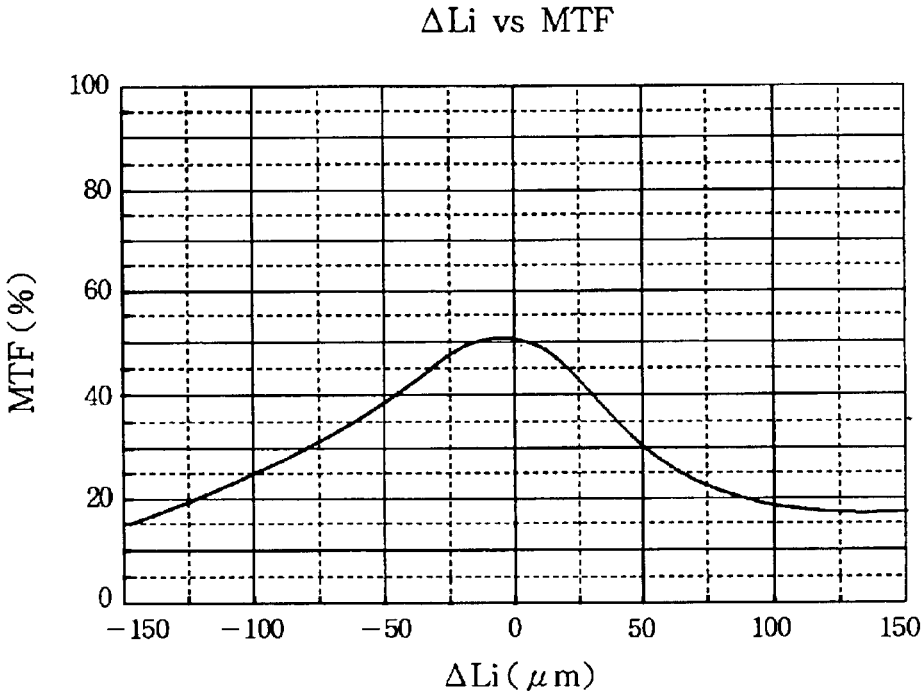
FIG. 37 illustrates the relationship between $\Delta Li$ and MTF.

FIG. 34 is a side view of the spacer of FIG. 32.

As shown in FIG. 31, the spacers 51*a* and 51*b* have grooves 63 formed in the abutting surface 52 that slides in contact with the photoconductive drum 6. As described in the second embodiment, the spacers 51*a* and 51*b* are formed of general purpose engineering plastics and are usually formed by injection molding for low manufacturing cost. Due to differences in thickness of various portions, a molded part often suffers from differences in shrinkage during manufacture. The differences in shrinkage cause sink marks 58, i.e., dimple-like recesses in the surface of the molded part. Just like ordinary molded parts, the spacers 51*a* and 51*b* actually had sink marks 58 developed in the abutting surface 52 in contact with the photoconductive drum 6. As shown in FIG. 31, the sink marks 58 in the abutting surface 52 reduces an area in contact with the photoconductive drum 6, increasing a pressure per unit area ($N/mm^2$) so that the surfaces of the photoconductive drum 6 and the spacers 51*a* and 51*b* wear out quickly. Forming the grooves 63 in the abutting surfaces 52 of the spacers 51*a* and 51*b* as shown in FIGS. 32–34 reduces differences in thickness among various portions of the spacers, thereby minimizing chances of sink marks 58 developing and thus reducing the frictional wear of the photoconductive drum and spacers. Thus, the distance Li between the light exiting end of the SLA and the photoconductive drum 6 can be maintained in the relation of Li=Lo for a long period of time.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an image bearing body that extends in a direction of a longitudinal axis thereof and rotates about the longitudinal axis;

an optical head that extends parallel to the longitudinal axis; and at least one distance-maintaining member disposed in sliding contact with said image bearing body, the distance-maintaining member maintaining a distance between said optical head and said image bearing body.

2. The image forming apparatus of claim 1 wherein said image bearing body has a photoconductor thereon having a first surface and said distance-maintaining member has a second surface in sliding contact with the first surface of the photoconductor.

3. The image forming apparatus of claim 2 wherein the first surface has a first curvature and the second surface has a second curvature; and wherein when the second surface is pressed against the first surface, the distance-maintaining member deforms resiliently so that the second curvature becomes substantially equal to the first curvature.

4. The image forming apparatus of claim 3 wherein the second surface has a groove formed therein.

5. The image forming apparatus of claim 2 further comprising a charging roller that extends in a direction parallel with the axis, the charging roller being in contact with the photoconductor;

wherein the distance-maintaining member is located outside of an area in which the charging roller is in contact with the photoconductor.

6. The image forming apparatus of claim 3 further comprising an adjusting mechanism that is held sandwiched between the optical head and the distance-maintaining member, and is operated to adjust a position of the optical head relative to the image bearing body.

7. The image forming apparatus of claim 6 wherein the adjusting mechanism is an eccentric cam mechanism.

8. The image forming apparatus of claim 3 wherein the first surface and the second surface have a substantially same curvature, and are concentric to each other.

9. The image forming apparatus of claim 1 wherein said distance-maintaining member has a first surface, said image bearing body has a member that is coaxial with said image bearing body and rotates in sliding contact with the first surface together with the image bearing body.

10. The image forming apparatus of claim 1 wherein said image bearing body has a first surface and said distance-maintaining member has a second surface in sliding contact with the first surface, the first surface being substantially concentric with respect to the second surface.

11. The image forming apparatus of claim 1 wherein said distance-maintaining member is mounted on an image drum unit on which said image bearing body is rotatably supported.

12. The image forming apparatus of claim 1 further comprising an urging means positioned to urge said distance-maintaining member substantially on a line of action of an urging force of the urging means.

* * * * *